US009315932B2

(12) United States Patent
Abe et al.

(10) Patent No.: US 9,315,932 B2
(45) **Date of Patent: *Apr. 19, 2016**

(54) SEWING MACHINE AND NON-TRANSITORY COMPUTER-READABLE MEDIUM STORING SEWING MACHINE CONTROL PROGRAM

(71) Applicant: Brother Kogyo Kabushiki Kaisha, Nagoya-shi, Aichi-ken (JP)

(72) Inventors: Daisuke Abe, Nagoya (JP); Satoru Ichiyanagi, Nagoya (JP); Yoshinori Nakamura, Toyohashi (JP); Yoshio Nishimura, Nagoya (JP); Akie Shimizu, Nagoya (JP); Yuki Ihira, Kakamigahara (JP); Satoru Makino, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 535 days.

This patent is subject to a terminal disclaimer.

(21) Appl. No.: 13/789,046

(22) Filed: Mar. 7, 2013

(65) Prior Publication Data

US 2013/0233221 A1 Sep. 12, 2013

(30) Foreign Application Priority Data

Mar. 12, 2012 (JP) ..... 2012-055104

(51) Int. Cl.
*D05B 19/12* (2006.01)

(52) U.S. Cl.
CPC ..... *D05B 19/12* (2013.01)

(58) Field of Classification Search
CPC ..... D05B 21/00; D05B 59/02; D05B 19/08; D05B 19/12; D05B 35/102; D05B 39/00; D05C 15/26; B26D 5/00
USPC ..... 112/470.06, 102.5, 470.01, 470.03, 112/470.04, 470.09, 470.14, 470.18, 112/475.02, 475.19, 80.23; 700/135, 137
See application file for complete search history.

(56) References Cited

U.S. PATENT DOCUMENTS 3,966,331 A 6/1976 Inuiya
4,712,497 A 12/1987 Nomura et al.

(Continued)

FOREIGN PATENT DOCUMENTS

JP S61-131787 A 6/1986
JP S64-040386 3/1989

(Continued)

OTHER PUBLICATIONS

Jul. 30, 2014 Office Action issued in U.S. Appl. No. 13/788,903.

(Continued)

*Primary Examiner* — Tejash Patel
(74) *Attorney, Agent, or Firm* — Oliff PLC

(57) ABSTRACT

A sewing machine includes at least one ultrasonic wave detecting portion, a thickness detecting portion, a processor, and a memory. The at least one ultrasonic wave detecting portion is configured to detect an ultrasonic wave. The thickness detecting portion is configured to detect a thickness of a work cloth. The memory configured to store computer-readable instructions that instruct the sewing machine to execute steps that includes identifying a position, on the work cloth, of a transmission source of the ultrasonic wave, based on information pertaining to the ultrasonic wave that has been detected by the at least one ultrasonic wave detecting portion and on the thickness that has been detected by the thickness detecting portion, and controlling sewing on the work cloth based on the position of the transmission source that has been identified.

12 Claims, 13 Drawing Sheets

(56) References Cited

U.S. PATENT DOCUMENTS

| | | | | |
|---|---|---|---|---|
| 4,998,489 | A | 3/1991 | Hisatake et al. | |
| 5,072,680 | A | 12/1991 | Nakashima | |
| 5,195,451 | A | 3/1993 | Nakashima | |
| 5,553,559 | A | 9/1996 | Inoue et al. | |
| 5,855,176 | A | 1/1999 | Takenoya et al. | |
| 6,000,350 | A | 12/1999 | Koike et al. | |
| 6,167,822 | B1 | 1/2001 | Miyasako et al. | |
| 6,871,606 | B2 | 3/2005 | Schweizer | |
| 6,883,446 | B2 | 4/2005 | Koerner | |
| 7,079,917 | B2 | 7/2006 | Taguchi et al. | |
| 7,155,302 | B2 | 12/2006 | Muto et al. | |
| 7,373,891 | B2 | 5/2008 | Koerner | |
| 7,854,207 | B2 | 12/2010 | Kuki et al. | |
| 8,061,286 | B2 | 11/2011 | Hirata et al. | |
| 8,074,590 | B2 | 12/2011 | Bentley | |
| 8,286,568 | B2 | 10/2012 | Tokura | |
| 8,301,292 | B2 | 10/2012 | Tokura | |
| 8,463,420 | B2 * | 6/2013 | Tokura | D05B 19/12 112/475.19 |
| 8,528,491 | B2 | 9/2013 | Bentley | |
| 8,567,329 | B2 | 10/2013 | Kishi | |
| 8,720,353 | B2 * | 5/2014 | Nakamura | D05B 19/12 112/102.5 |
| 8,763,542 | B2 | 7/2014 | Abe et al. | |
| 8,857,355 | B2 * | 10/2014 | Nomura | D05B 19/12 112/470.06 |
| 9,096,962 | B2 * | 8/2015 | Shimizu | D05B 19/12 |
| 2004/0182295 | A1 | 9/2004 | Pfeifer | |
| 2009/0188413 | A1 | 7/2009 | Hirata et al. | |
| 2011/0048299 | A1 | 3/2011 | Tokura | |
| 2011/0226170 | A1 | 9/2011 | Tokura | |
| 2012/0000249 | A1 | 1/2012 | Hamada | |
| 2012/0111249 | A1 | 5/2012 | Sekine | |
| 2012/0210925 | A1 | 8/2012 | Koga et al. | |
| 2013/0233217 | A1 | 9/2013 | Shimizu et al. | |
| 2013/0233219 | A1 | 9/2013 | Nakamura et al. | |
| 2013/0233220 | A1 | 9/2013 | Nomura et al. | |
| 2013/0233221 | A1 | 9/2013 | Abe et al. | |
| 2013/0233222 | A1 | 9/2013 | Nishimura et al. | |
| 2014/0000498 | A1 | 1/2014 | Yamanashi et al. | |

FOREIGN PATENT DOCUMENTS

| | | |
|---|---|---|
| JP | A-06-000264 | 1/1994 |
| JP | A-2007-128120 | 5/2007 |
| JP | A-2009-172123 | 8/2009 |

OTHER PUBLICATIONS

Feb. 4, 2014 Office Action issued in Japanese Patent Application No. 2012-055103 (with English Translation).

U.S. Appl. No. 13/788,903, filed Mar. 7, 2013 in the name of Yoshio Nishimura et al.

U.S. Appl. No. 13/788,928, filed Mar. 7, 2013 in the name of Yoshinori Nakamura et al.

U.S. Appl. No. 13/789,061, filed Mar. 7, 2013 in the name of Yoshio Nishimura et al.

U.S. Appl. No. 13/788,979, filed Mar. 7, 2013 in the name of Yutaka Nomura et al.

U.S. Appl. No. 13/788,893, filed Mar. 7, 2013 in the name of Akie Shimizu et al.

Mar. 10, 2015 Patent Office Communication issued in U.S. Appl. No. 13/788,893.

Feb. 20, 2015 Office Action issued in U.S. Appl. No. 13/788,893.

Feb. 26, 2015 Office Action issued in U.S. Appl. No. 13/789,061.

Mar. 3, 2015 Office Action issued in Japanese Application No. 2014-059717.

Mar. 4, 2014 Office Action issued in U.S. Appl. No. 13/788,979.

* cited by examiner

SEWING MACHINE AND NON-TRANSITORY COMPUTER-READABLE MEDIUM STORING SEWING MACHINE CONTROL PROGRAM

CROSS-REFERENCE TO RELATED APPLICATION

This application claims priority to Japanese Patent Application No. 2012-055104 filed Mar. 12, 2012, the content of which is hereby incorporated herein by reference.

BACKGROUND

The present disclosure relates to a sewing machine and a non-transitory computer-readable medium storing a sewing machine control program that allow sewing in a position specified on a work cloth.

A sewing machine is known that can easily set a sewing position and a sewing angle, at which a desired embroidery pattern is to be sewn, on a work cloth. For example, a known sewing machine includes an imaging portion. After a user affixes a marker to a specified position on the work cloth, an image of the marker may be captured by the imaging portion. The sewing machine may automatically set the sewing position and the sewing angle of the embroidery pattern based on the captured image of the marker.

SUMMARY

However, with the above-described sewing machine, it may be necessary to affix the marker to the work cloth. Further, after the sewing machine has set the sewing position and the sewing angle of the embroidery pattern, the user may need to remove the marker affixed to the work cloth before sewing is performed. Therefore, the operation may be troublesome for the user.

Embodiments of the broad principles derived herein provide a sewing machine and a non-transitory computer-readable medium storing a sewing machine control program that enable easily setting a position, on a work cloth, at which sewing is performed.

Embodiments provide a sewing machine that includes at least one ultrasonic wave detecting portion, a thickness detecting portion, a processor, and a memory. The at least one ultrasonic wave detecting portion is configured to detect an ultrasonic wave. The thickness detecting portion is configured to detect a thickness of a work cloth. The memory is configured to store computer-readable instructions that instruct the sewing machine to execute a step that includes identifying a position, on the work cloth, of a transmission source of the ultrasonic wave, based on information pertaining to the ultrasonic wave that has been detected by the at least one ultrasonic wave detecting portion and on the thickness that has been detected by the thickness detecting portion. The memory is also configured to store computer-readable instructions that instruct the sewing machine to execute a step that includes controlling sewing on the work cloth based on the position of the transmission source that has been identified.

Embodiments also provide a non-transitory computer-readable medium storing a control program executable on a sewing machine. The program includes computer-readable instructions, when executed, to cause the sewing machine to perform the step of identifying a position, on a work cloth, of a transmission source of the ultrasonic wave, based on information pertaining to a ultrasonic wave that has been detected by at least one ultrasonic wave detecting portion of the sewing machine and on a thickness that has been detected by a thickness detecting portion of the sewing machine, the at least one ultrasonic wave detecting portion being configured to detect the ultrasonic wave, and the thickness detecting portion being configured to detect the thickness of the work cloth. The program further includes computer-readable instructions, when executed, to cause the sewing machine to perform the step of controlling sewing on the work cloth based on the position of the transmission source that has been identified.

BRIEF DESCRIPTION OF THE DRAWINGS

Embodiments will be described below in detail with reference to the accompanying drawings in which.

DETAILED DESCRIPTION

Figure 1:
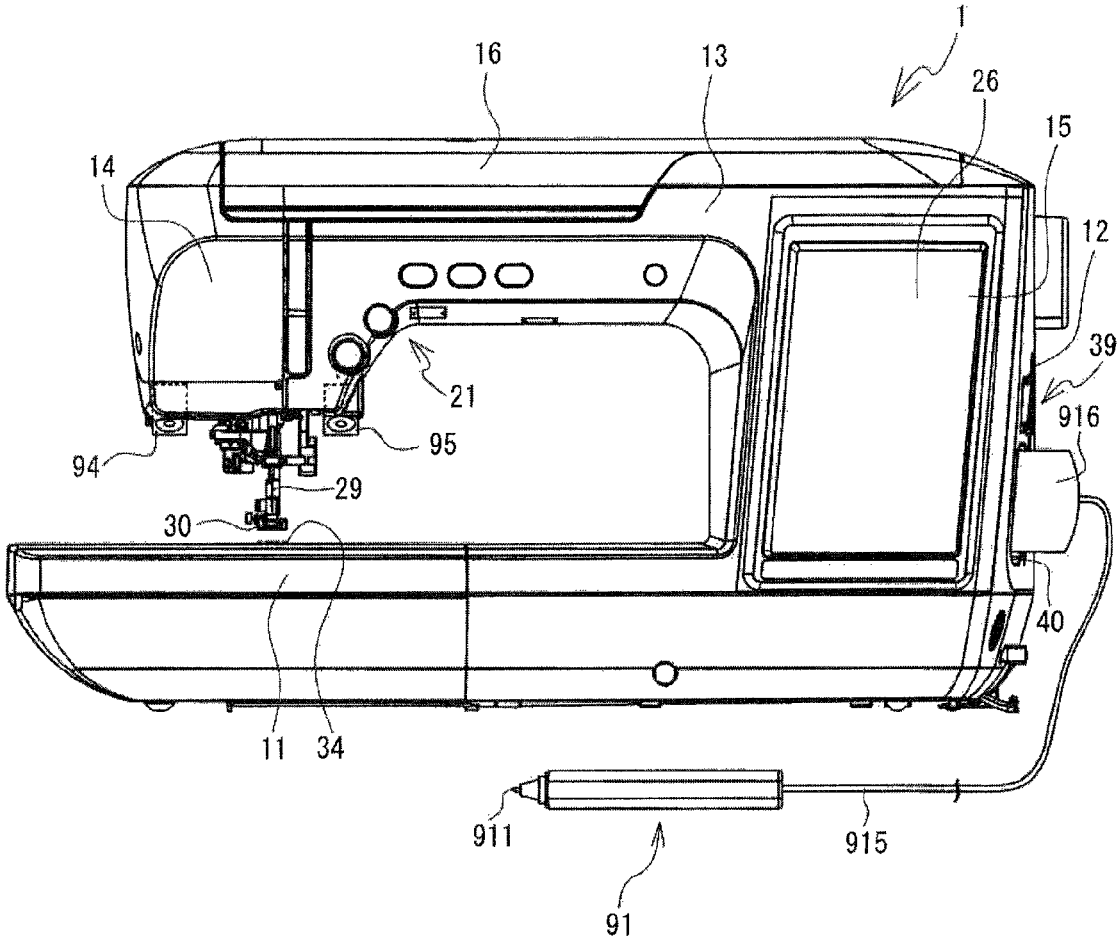
FIG. 1 is a front view of a sewing machine.

Hereinafter, an embodiment will be explained with reference to the appended drawings. First, a physical structure of a sewing machine 1 will be explained with reference to FIG. 1. In the following explanation, the near side, the far side, the upper side, the lower side, the left side, and the right side of FIG. 1 are respectively defined as the front side, the rear side, the upper side, the lower side, the left side, and the right side of the sewing machine 1. In other words, a direction in which a pillar 12, which will be explained below, extends is the up-down direction of the sewing machine 1. A longitudinal direction of a bed 11 and an arm 13 is the left-right direction of the sewing machine 1. A surface on which a switch cluster 21 is arranged is the front surface of the sewing machine 1.

As shown in FIG. 1, the sewing machine 1 includes the bed 11, the pillar 12, the arm 13, and a head 14. The bed 11 is longer in the left-right direction. The pillar 12 extends upward from the right end of the bed 11. The arm 13 extends to the left from the upper end of the pillar 12. The head 14 is provided on the left side of the arm 13. The bed 11 is provided with a needle plate 22 (refer to FIG. 2), a feed dog 34, a cloth feed mechanism (not shown in the drawings), a feed adjustment motor 83 (refer to FIG. 7), and a shuttle mechanism (not shown in the drawings). The needle plate 22 is disposed on an upper surface of the bed 11. The feed dog 34 is provided under the needle plate 22 and may feed, by a specified feed distance, a work cloth 100 (refer to FIG. 2) on which sewing is performed. The cloth feed mechanism may drive the feed dog 34. The feed adjustment motor 83 may adjust the feed distance. The head 14 is provided with a needle bar mechanism (not shown in the drawings), a needle bar swinging motor 80 (refer to FIG. 7), and a thread take-up mechanism (not shown in the drawings). The needle bar mechanism may move a needle bar (not shown in the drawings) in the up-down direction. A sewing needle 29 may be attached to the needle bar. The needle bar swinging motor 80 may swing the needle bar in the left-right direction. Two receivers 94 and 95 are provided on the rear portion of the lower edge of the head 14 such that the receivers 94 and 95 are separated to the left and to the right. The receivers 94 and 95 are configured to detect an ultrasonic wave transmitted by an ultrasonic pen 91 (to be explained below). It is assumed that the upper surface of the bed 11 and an upper surface of the needle plate 22 are substantially the same height.

A vertically rectangular liquid crystal display 15 is provided on the front face of the pillar 12. For example, keys that are used to execute various functions necessary to the sewing operation, various messages, and various patterns etc. are displayed on the liquid crystal display 15.

A transparent touch panel 26 is provided in the upper surface (front surface) of the liquid crystal display 15. A user may perform an operation of pressing the touch panel 26, using a finger or a dedicated touch pen, in a position corresponding to one of the various keys or the like displayed on the liquid crystal display 15. This operation is hereinafter referred to as a "panel operation." The touch panel 26 detects the position pressed by the finger or the dedicated touch pen etc., and the sewing machine 1 (more specifically, a CPU 61 to be described below) determines an item corresponding to the detected position. In this way, the sewing machine 1 recognizes the selected item. By performing the panel operation, the user can perform pattern selection and various settings etc.

Connectors 39 and 40 are provided in the right face of the pillar 12. An external storage device (not shown in the drawings), such as a memory card, can be connected to the connector 39. Via the connector 39, the sewing machine 1 can read pattern data and various programs into the sewing machine 1 from the external storage device, and can output pattern data and various programs to the outside of the sewing machine 1. A connector 916 may be connected to the connector 40. The connector 916 is provided on an end of a cable 915 that extends from the ultrasonic pen 91 (to be explained below). Via the connector 40, the sewing machine 1 may supply electric power to the ultrasonic pen 91 and may detect various signals (a transmission start signal etc. that will be explained below) output from the ultrasonic pen 91.

The structure of the arm 13 will be explained. A cover 16 is attached to the upper portion of the arm 13. The cover 16 is provided in the longitudinal direction of the arm 13. The cover 16 is supported such that the cover 16 can be opened and closed by being rotated about an axis that extends in the left-right direction at the upper rear edge of the arm 13. A thread spool pin (not shown in the drawings) is provided underneath the cover 16 in the interior of the arm 13. A thread spool may be mounted on the thread spool pin. A thread spool may supply a thread to the sewing machine 1. Although not shown in the drawings, an upper thread that extends from the thread spool may be supplied to the sewing needle 29 that is attached to the needle bar, via a tensioner, a thread take-up spring, and a thread take-up lever, which are provided on the head 14.

A sewing machine motor 79 (refer to FIG. 7) is provided in the arm 13. The sewing machine motor 79 may rotate a drive shaft (not shown in the drawings), which extends in the longitudinal direction of the arm 13. The needle bar mechanism and the thread take-up mechanism are driven by the rotation of the drive shaft.

The switch cluster 21 is provided in a lower portion of the front face of the arm 13. The switch cluster 21 includes a sewing start/stop switch, a reverse stitch switch, a needle up/down switch, and a presser foot up/down switch, and the like.

A presser bar 52 (refer to FIG. 2) and a presser foot lifting mechanism 20 are disposed to the rear of the needle bar. The presser foot lifting mechanism 20 may move the presser bar 52 in the up-down direction. A presser foot 30 may be detachably (replaceably) attached to the lower end of the presser bar 52. The presser foot 30 may apply pressure to the work cloth 100.

Figure 2:
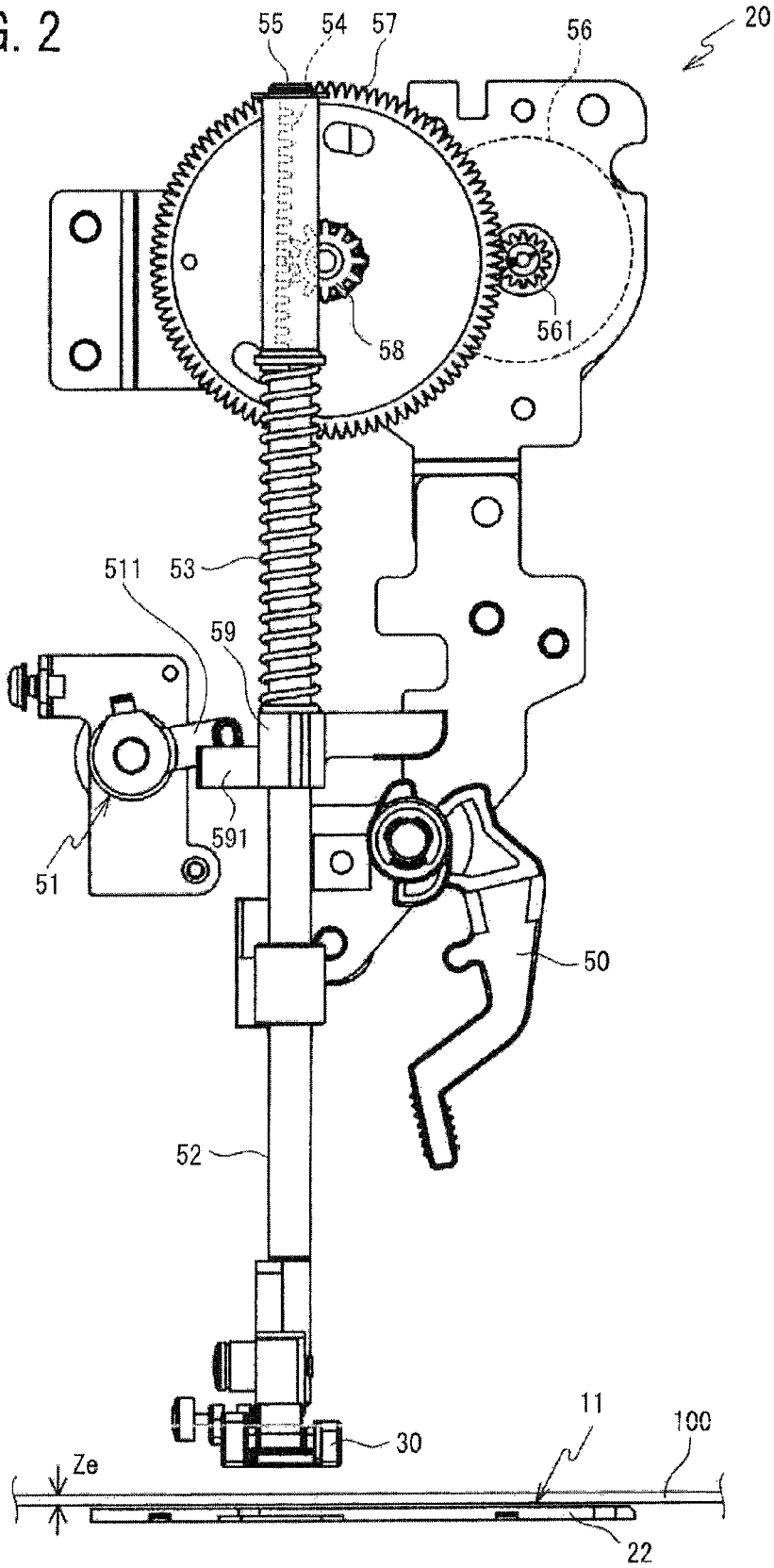
FIG. 2 is a front view of a presser foot lifting mechanism in a state in which the presser foot is separated from a work cloth.
Figure 3:
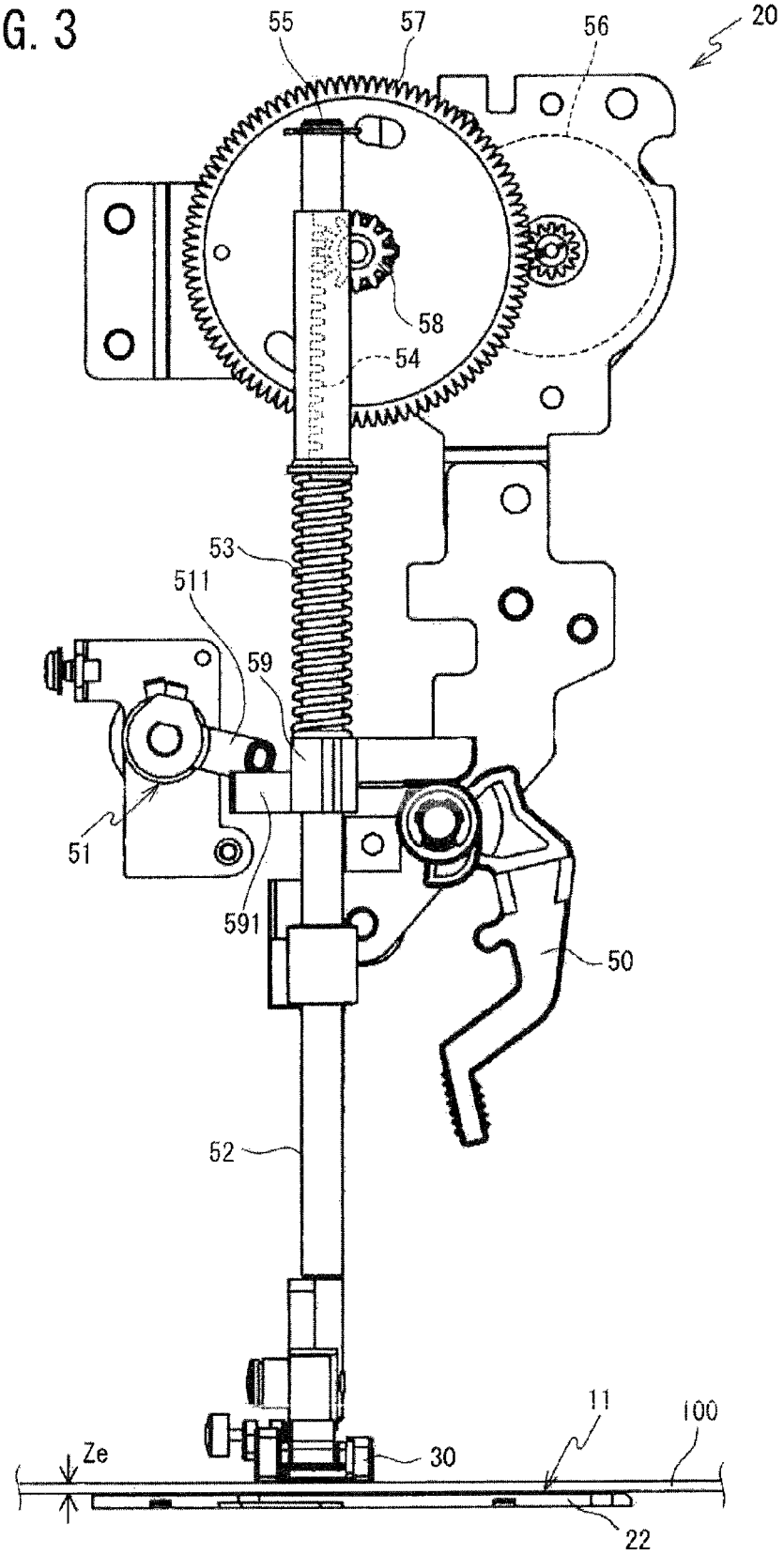
FIG. 3 is a front view of the presser foot lifting mechanism in a state in which the presser foot is pressing the work cloth.

A structure of the presser foot lifting mechanism 20 will be explained with reference to FIG. 2 and FIG. 3. The presser foot lifting mechanism 20 includes the presser bar 52, the presser foot 30, a rack member 54, a retaining ring 55, a presser foot lifting motor 56, a drive gear 561, an intermediate gear 57, a pinion 58, a presser bar guide bracket 59, a presser bar spring 53, a presser lifting lever 50, and a potentiometer 51.

The presser bar 52 extends in the up-down direction. The presser bar 52 is supported by a sewing machine frame (not shown in the drawings) such that the presser bar 52 can be moved in the up-down direction. The rack member 54 has a toothed portion that meshes with the pinion 58 that will be explained below. The rack member 54 is provided around the upper end portion of the presser bar 52 such that the rack member 54 can be slid. The retaining ring 55 is fixed to the upper end of the presser bar 52. The presser bar guide bracket 59 is fixed substantially in the center, in the up-down direction, of the presser bar 52. The presser bar spring 53 is provided around the presser bar 52 in a position where the presser bar spring 53 is sandwiched between the rack member 54 and the presser bar guide bracket 59. The presser foot lifting motor 56 is fixed to the sewing machine frame in a position to the right of the rack member 54. The drive gear 561 is fixed to an output shaft of the presser foot lifting motor 56. The drive gear 561 rotates integrally with the output shaft. The intermediate gear 57 is rotatably supported by the sewing machine frame. The intermediate gear 57 meshes with the drive gear 561 and may rotate in accordance with the rotation of the drive gear 561. The pinion 58 is formed integrally with the intermediate gear 57. The pinion 58 meshes with the toothed portion of the rack member 54.

A case is considered in which the presser foot lifting motor 56 is driven and the drive gear 561 is rotated in the counterclockwise direction. In this case, the rotation of the drive gear 561 is transmitted to the intermediate gear 57 and the pinion 58, and the rack member 54 is moved upward. As shown in FIG. 2, when the rack member 54 is moved upward, the upper end surface of the rack member 54 comes into contact with the retaining ring 55, which is fixed to the upper end of the presser bar 52. As a result of this, the presser bar 52 is raised and the presser foot 30 is also raised. A case is considered in which the presser foot lifting motor 56 is driven and the drive gear 561 is rotated in the clockwise direction, from a state in which the presser foot 30 is raised (refer to FIG. 2). In this case, the rack member 54 is moved downward and the presser bar spring 53 that is in contact with the lower end surface of the rack member 54 is depressed downward, as shown in FIG. 3. As a result of this, the presser bar guide bracket 59 is depressed downward, and the presser foot 30 may press the work cloth 100 that is placed on the needle plate 22 downward.

The presser lifting lever 50 is a known lever that is used when an operation (a manual operation by the user) to raise or lower the presser bar 52 is performed independently of the up-down movement (the raising and lowering) of the presser bar 52 by the presser foot lifting motor 56. Although not explained in detail, the presser lifting lever 50 is pivotally supported by the sewing machine frame such that the presser lifting lever 50 can be swung. In accordance with the raising and lowering operation of the presser lifting lever 50, the presser lifting lever 50 may come into contact, from underneath, with the presser bar guide bracket 59, and the presser bar 52 may thus be moved in the up-down direction.

The potentiometer 51 is provided on the left side of the presser bar 52. The potentiometer 51 is a rotary potentiometer. Based on a resistance value that changes depending on an amount of rotation of the potentiometer 51, the potentiometer 51 may detect a vertical position (a height position) of the presser bar 52. A lever 511, which extends to the right, is provided on a rotating shaft of the potentiometer 51. The leading end of the lever 511 is in contact with an upper surface of a protruding portion 591, which protrudes to the left of the presser bar guide bracket 59. The leading end of the lever 511 is constantly biased to be in contact with the upper surface of the protruding portion 591 by a coil spring that is not shown in the drawings.

The lever 511 rotates when the presser bar guide bracket 59 is moved in the up-down direction. As a result, the resistance value of the potentiometer 51 changes in accordance with an angle of rotation of the lever 511. The CPU 61 (refer to FIG. 7), which will be explained below, detects the vertical position of the presser bar 52 (the presser foot 30) based on a voltage that corresponds to the resistance value. Here, a position of the presser foot 30 when there is no work cloth 100, namely, a position in which the presser foot 30 is in contact with the upper surface of the needle plate 22, is taken as a reference position. The voltage corresponding to the resistance value of the potentiometer 51 when the presser foot 30 is in the reference position is set as a reference value by the CPU 61. The CPU 61 detects the height position of the presser foot 30 by comparing the reference value with a voltage corresponding to the resistance value of the potentiometer 51 in a state in which the presser foot 30 is pressing the work cloth 100. By detecting the height position of the presser foot 30 in this way, the CPU 61 can accurately detect the thickness of the work cloth 100.

The ultrasonic pen 91 will be explained with reference to FIG. 1. For example, the user may use the ultrasonic pen 91 to specify a position on which sewing is to be performed on the work cloth 100. The sewing machine 1 may identify the position specified by the user based on the ultrasonic wave transmitted from the ultrasonic pen 91 and on the transmission start signal (to be explained below), and may perform sewing in the specified position.

A pen tip 911 is provided at the leading end of the ultrasonic pen 91. The pen tip 911 can be moved toward the inside of a pen body of the ultrasonic pen 91 (in the rearward direction of the ultrasonic pen 91). Normally, the pen tip 911 is in a protruding position in which the pen tip 911 protrudes slightly to the outside from the pen body. When a force acts on the pen tip 911 in the rearward direction, the pen tip 911 enters into the pen body. When the force acting on the pen tip 911 is released, the pen tip 911 returns to the original protruding position. An electric substrate (not shown in the drawings) is provided in the interior of the ultrasonic pen 91. The electric substrate may be connected to a control portion 60 (refer to FIG. 7) of the sewing machine 1, via the cable 915 that extends from the rear end of the ultrasonic pen 91.

Figure 7:
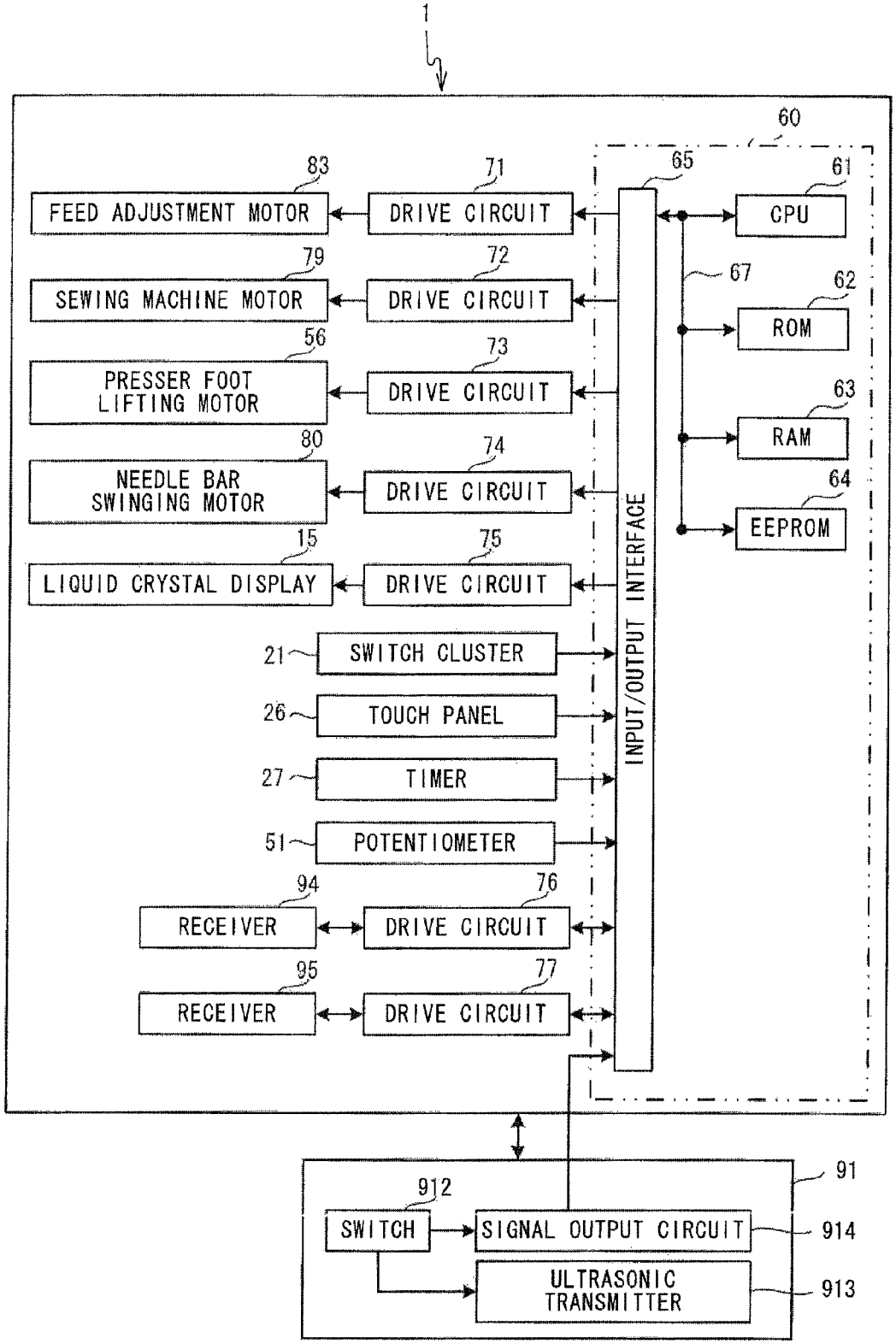
FIG. 7 is a block diagram showing an electrical configuration of the sewing machine and an ultrasonic pen.

A switch 912, an ultrasonic transmitter 913, and a signal output circuit 914 etc. are mounted on the electric substrate (refer to FIG. 7). The switch 912 is provided facing the rear end of the pen tip 911. The ultrasonic transmitter 913 is an ultrasonic wave transmission source. The ultrasonic transmitter 913 transmits an ultrasonic wave when the switch 912 is pressed. The ultrasonic transmitter 913 is provided in a position that is extremely close to the pen tip 911. The signal output circuit 914 normally outputs a High signal to the sewing machine 1 via the cable 915. Then, when the switch 912 is pressed, the signal output circuit 914 outputs a Low signal to the sewing machine 1 via the cable 915. An output timing of the Low signal is the same timing as the transmission of the ultrasonic wave by the ultrasonic transmitter 913. Namely, the Low signal is a signal (hereinafter referred to as the "transmission start signal") that indicates that the transmission of the ultrasonic wave by the ultrasonic transmitter 913 has started. The signal output circuit 914 notifies the sewing machine 1 of the timing at which the ultrasonic wave is transmitted by the ultrasonic transmitter 913 by outputting the transmission start signal in this way.

When the user holds the ultrasonic pen 91 with the user's hand and causes the pen tip 911 to touch a given position on the work cloth 100, the pen tip 911 is moved in the rearward direction. When the pen tip 911 is moved in the rearward direction of the ultrasonic pen 91, the rear end of the pen tip 911 comes into contact with the switch 912 and depresses the switch 912. When the switch 912 is depressed, the ultrasonic wave is transmitted from the ultrasonic transmitter 913. Further, the transmission start signal (the Low signal) is output from the signal output circuit 914. The ultrasonic wave transmitted from the ultrasonic transmitter 913 may be received by the receivers 94 and 95 (refer to FIG. 1).

The receivers 94 and 95 will be explained with reference to FIG. 4 to FIG. 6. Structures of the receivers 94 and 95 are the same, and an explanation of the receiver 95 will therefore be omitted, and the receiver 94 will be explained. In the explanation below, the lower left side, the upper right side, the upper left side, the lower right side, the upper side, and the lower side in FIG. 4 respectively define the front side, the rear side, the left side, the right side, the upper side, and the lower side of the receiver 94.

Figure 4:
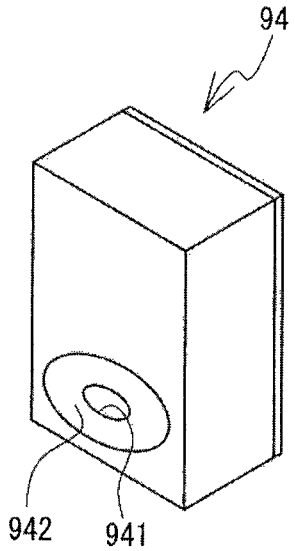
FIG. 4 is a perspective view of a receiver.
Figure 5:
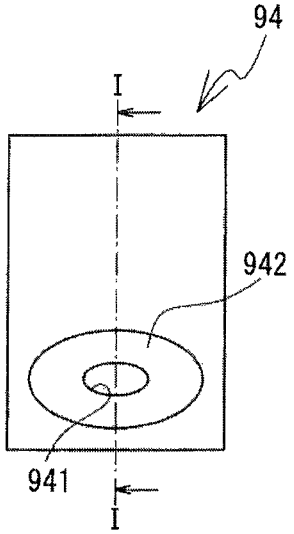
FIG. 5 is a front view of the receiver.
Figure 6:
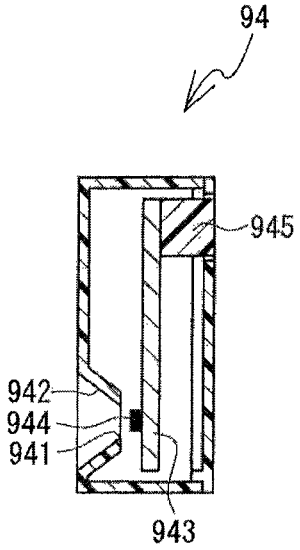
FIG. 6 is a cross-sectional view of the receiver taken along a line I-I shown in FIG. 5, as seen in an arrow direction.

As shown in FIG. 4 to FIG. 6, the receiver 94 has a rectangular parallelepiped shape that is slightly longer in the up-down direction. An opening 941 is provided in the center of the lower edge of the front surface of the receiver 94. The opening 941 has an elliptic shape that is long in the left-right direction. A wall 942 around the opening 941 is a taper-shaped surface (an inclined surface) that becomes narrower from the outer side toward the inner side of the front surface of the receiver 94. A microphone 944, which is mounted on an electric substrate 943, is provided, inside the receiver 94, behind the opening 941. A connector 945 is mounted on the upper end of the rear surface of the electric substrate 943. The receiver 94 may be electrically connected to the sewing machine 1 by the connector 945 being connected to a connector (not shown in the drawings) provided on the sewing machine 1. An orientation of the receiver 94 is determined by a direction of the opening 941 in relation to the microphone 944.

In a case where the ultrasonic wave is transmitted from the ultrasonic transmitter 913, the ultrasonic wave may be received by the microphone 944 of the receiver 94. The receiver 94 may output the received ultrasonic wave, as an electrical signal, to the sewing machine 1 via the connector 945. The sewing machine 1 may detect the ultrasonic wave in this way.

An electrical configuration of the sewing machine 1 and the ultrasonic pen 91 will be explained with reference to FIG. 7. As shown in FIG. 7, the control portion 60 of the sewing machine 1 includes the CPU 61, a ROM 62, a RAM 63, an EEPROM 64, and an input/output interface 65, which are mutually connected via a bus 67. The ROM 62 stores programs and data etc. that are used by the CPU 61 to execute processing. The EEPROM 64 stores data of a plurality of types of sewing patterns that are used for the sewing machine 1 to perform sewing.

The switch cluster 21, the touch panel 26, a timer 27, the potentiometer 51, and drive circuits 71 to 77 are electrically connected to the input/output interface 65. The timer 27 may measure time. The drive circuit 71 may drive the feed adjustment motor 83. The drive circuit 72 may drive the sewing machine motor 79. The drive circuit 73 may drive the presser foot lifting motor 56. The drive circuit 74 may drive the needle bar swinging motor 80. The drive circuit 75 may drive the liquid crystal display 15. The drive circuits 76 and 77 may drive the receiver 94 and the receiver 95, respectively. The drive circuits 76 and 77 include amplifier circuits that amplify the electrical signals output from the receivers 94 and 95 and transmit the amplified electrical signals to the CPU 61.

As described above, the switch 912, the ultrasonic transmitter 913, and the signal output circuit 914 are mounted on the electric substrate inside the ultrasonic pen 91. The switch 912 is connected to the ultrasonic transmitter 913 and to the signal output circuit 914. The signal output circuit 914 is connected to the CPU 61 via the input/output interface 65. The signal output circuit 914 may output the transmission start signal to the CPU 61.

A calculation method used to calculate the position of the ultrasonic wave transmission source on the work cloth 100, namely the position specified by using the ultrasonic pen 91, will be explained. In the following explanation, the left-right direction of the sewing machine 1 is the X direction (X coordinates), the front-rear direction of the sewing machine 1 is the Y direction (Y coordinates), and the up-down direction of the sewing machine 1 is the Z direction (Z coordinates). As described above, the sewing machine 1 can perform sewing at the position on the work cloth 100 specified by using the ultrasonic pen 91. Here, if the thickness of the work cloth 100 is not taken into account when identifying the transmission source of the ultrasonic wave, an error may occur in the position (X coordinate, Y coordinate) of the identified transmission source. In particular, the greater the thickness, the greater error may occur in the position (X coordinate, Y coordinate) of the transmission source of the ultrasonic wave. For that reason, there is a possibility that the sewing is performed in a position that is separated from the specified position by the amount of the error. Therefore, in the present embodiment, the thickness is taken into account and the position (X coordinate, Y coordinate) of the transmission source of the ultrasonic wave is calculated, thus inhibiting occurrence of an error. Hereinafter, a calculation method used to calculate the position (X coordinate, Y coordinate) of the transmission source of the ultrasonic wave will be explained.

Figure 8:
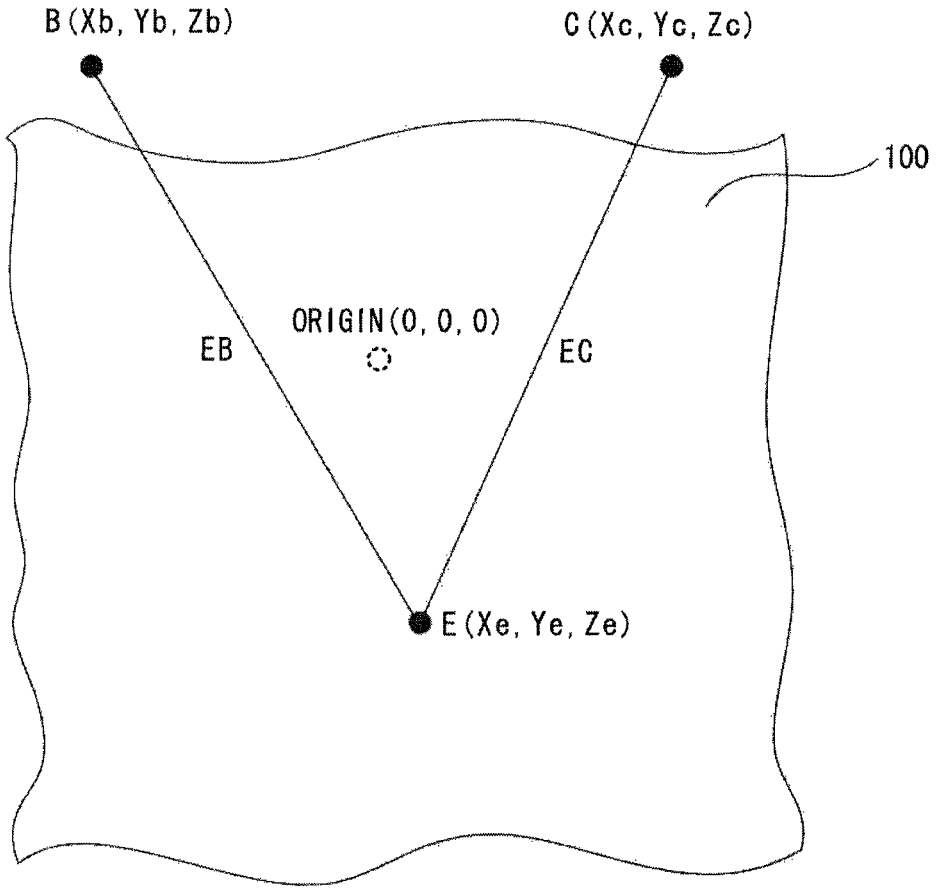
FIG. 8 is a plan view of the work cloth that is placed on a needle plate, showing positional relationships of respective coordinates in order to illustrate a method of calculating specified coordinates E.

In the following explanation, "1" in the X coordinate, the Y coordinate, and the Z coordinate corresponds to a distance of "1 mm" from an origin. As shown in FIG. 8, coordinates of a center position of a needle hole (not shown in the drawings) in the needle plate 22 that is penetrated by the sewing needle 29 are assumed to be the origin (0, 0, 0). Coordinates B indicating the position of the receiver 94 are denoted by (Xb, Yb, Zb), and coordinates C indicating the position of the receiver 95 are denoted by (Xc, Yc, Zc). Coordinates E of the position specified on the work cloth 100 using the ultrasonic pen 91 are denoted by (Xe, Ye, Ze). Hereinafter, the coordinates E are referred to as "specified coordinates E." A distance between the specified coordinates E and the coordinates B is referred to as a "distance EB." A distance between the specified coordinates E and the coordinates C is referred to as a "distance EC."

The Z coordinate of the upper surface of the needle plate 22 is zero. Thus, the Z coordinates of the receivers 94 and 95 indicate, respectively, distances between the needle plate 22 and the receivers 94 and 95 in an orthogonal direction (the up-down direction) that is orthogonal to the upper surface of the needle plate 22. As described above, the upper surface of the bed 11 and the upper surface of the needle plate 22 are substantially the same height, and therefore the Z coordinate of the bed 11 may be deemed to be zero. Then, the Z coordinates of the receivers 94 and 95 may indicate, respectively, distances between the upper surface of the bed 11 and the receivers 94 and 95 in an orthogonal direction (the up-down direction) that is orthogonal to the upper surface of the bed 11. The coordinates B (Xb, Yb, Zb) and the coordinates C (Xc, Yc, are stored in advance in the ROM 62.

In the case of the above-described conditions, a relationship of the following Formulas (1) and (2) is obtained.

$$(Xb-Xe)^2+(Yb-Ye)^2+(Zb-Ze)^2=(EB)^2 \quad \text{Formula (1):}$$

$$(Xc-Xe)^2+(Yc-Ye)^2+(Zc-Ze)^2=(EC)^2 \quad \text{Formula (2):}$$

Formulas (1) and (2) are the same as equations to calculate a spherical surface. In the present embodiment, the receivers 94 and 95 provided at the coordinates B and the coordinates C may receive the ultrasonic wave transmitted from the ultrasonic pen 91 (the ultrasonic wave transmitted from the specified coordinates E). Here, a speed at which the ultrasonic wave travels is assumed to be a sonic velocity V. A time period required from when the ultrasonic wave is transmitted from the ultrasonic pen 91 at the specified coordinates E to when the ultrasonic wave reaches the receiver 94 (to be detected by the receiver 94) is a propagation time Tb. A time period required from when the ultrasonic wave is transmitted from the ultrasonic pen 91 at the specified coordinates E to when the ultrasonic wave reaches the receiver 95 (to be detected by the receiver 95) is a propagation time Tc. In this case, the distance can be expressed as (speed×time). Thus, the distance EB between the specified coordinates E and the receiver 94, and the distance EC between the specified coordinates E and the receiver 95 in Formulas (1) and (2) can be expressed by the following Formulas (3) and (4).

$$EB=V\times Tb \quad \text{Formula (3):}$$

$$EC=V\times Tc \quad \text{Formula (4):}$$

Formulas (3) and (4) are substituted into Formulas (1) and (2), so that the following Formulas (5) and (6) can be obtained.

$$(Xb-Xe)^2+(Yb-Ye)^2+(Zb-Ze)^2=(V\times Tb)^2 \quad \text{Formula (5):}$$

$$(Xc-Xe)^2+(Yc-Ye)^2+(Zc-Ze)^2=(V\times Tc)^2 \quad \text{Formula (6):}$$

In Formulas (5) and (6), the coordinates B (Xb, Yb, Zb), the coordinates C (Xc, Yc, Zc), and the sonic velocity V are known values and are stored in the ROM 62. The propagation time Tb and the propagation time Tc can be calculated from a difference between a transmission timing T1 and a detection timing T2 of the ultrasonic wave, which will be explained below. The specified coordinates E may be coordinates of the position on the work cloth 100 specified using the ultrasonic pen 91. Thus, Ze of the specified coordinates E (Xe, Ye, Ze) may indicate the thickness of the work cloth 100. For that reason, Xe and Ye can be calculated by solving the simultaneous equations represented by the above-described Formulas (5) and (6). Here, taking orientations of the receivers 94 and 95 into account, the X coordinate "Xe" and the Y coordinate "Ye" of the specified coordinates E specified on the work cloth 100 using the ultrasonic pen 91 can be determined. The above-described Formulas (5) and (6) are stored in the ROM 62.

In the following explanation, in Formulas (5) and (6), distances in the up-down direction from the upper surface of the work cloth 100 to the receivers 94 and 95, namely the distances (Zb−Ze) and (Zc−Ze), are referred to as "first distance values." Distances from the transmission source of the ultrasonic wave (namely, the specified coordinates E) to the receivers 94 and 95, namely the distances (V×Tb) and (V×Tc), are referred to as "second distance values."

First main processing will be explained with reference to a flowchart in FIG. 9. The first main processing is performed by the CPU 61 of the sewing machine 1 in accordance with the program stored in the ROM 62. The first main processing may be started, for example, when an instruction is input via a panel operation to select the sewing pattern and to perform the sewing, in a state in which the presser foot 30 is pressing the work cloth 100. In the following explanation, as a specific example, the coordinates B of the receiver 94 are denoted by (Xb, Yb, Zb) and the coordinates C of the receiver 95 are denoted by (Xc, Yc, Zc) (refer to FIG. 8).

Figure 9:
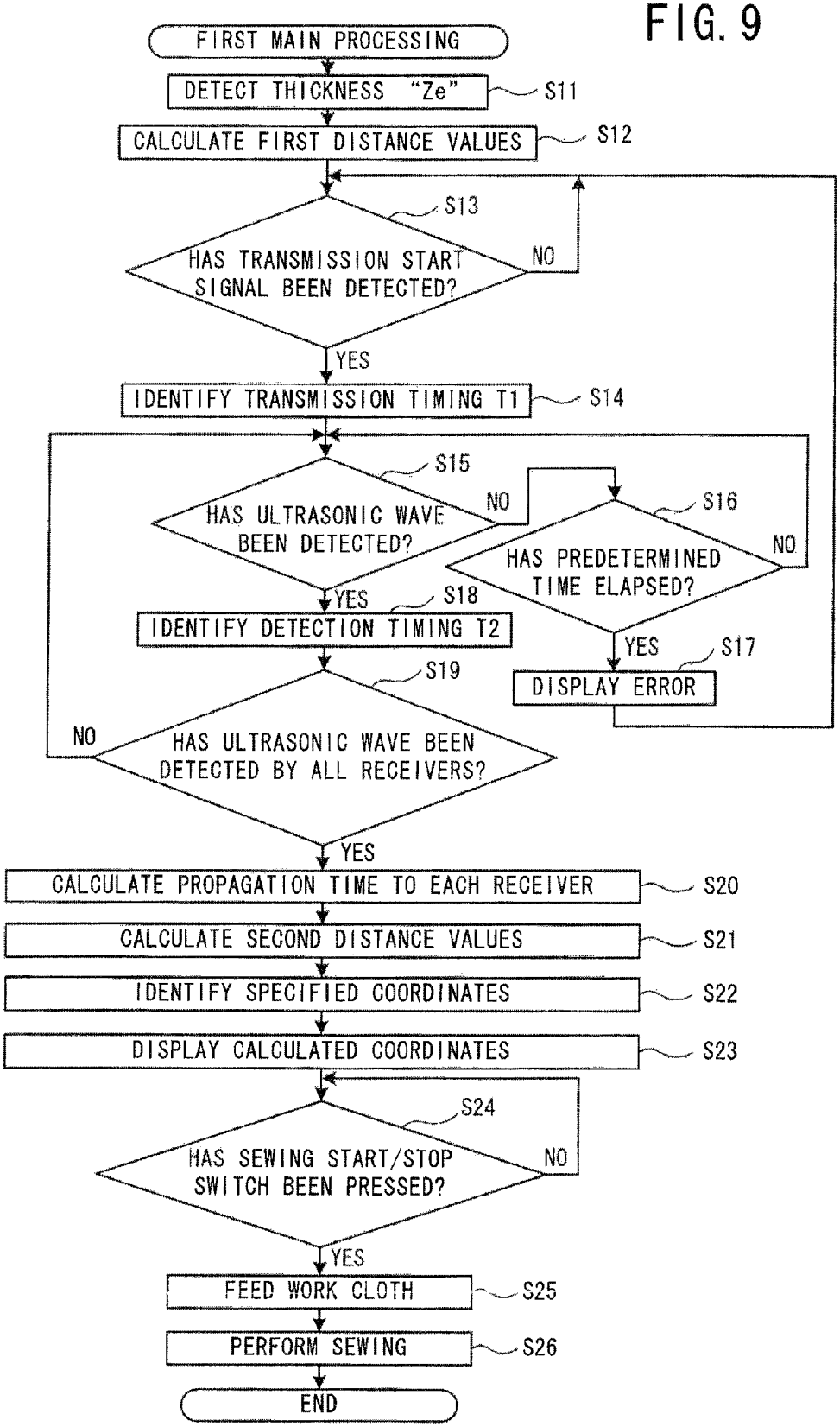
FIG. 9 is a flowchart showing first main processing.

As shown in FIG. 9, in the first main processing, first, the voltage corresponding to the resistance value of the potentiometer 51 is detected, and the thickness Ze of the work cloth 100 is detected using the method described above (step S11). The thickness Ze indicates a height from the needle plate 22 (the bed 11). Next, the first distance values are calculated (step S12). Specifically, the Z coordinates (Zb, Zc) of the receivers 94 and 95 stored in the ROM 62 are read out. Using the read out Z coordinates and the thickness Ze detected at step S11, the first distance value (Zb−Ze) for the receiver 94 and the first distance value (Zc−Ze) for the receiver 95 are calculated. At step S22 to be described below, the first distance values (Zb−Ze) and (Zc−Ze) calculated at step S12 are substituted into the above-described Formulas (5) and (6).

Next, a determination is made as to whether the transmission start signal from the ultrasonic pen 91 has been detected (step S13). If the transmission start signal has not been detected (NO at step S13), the processing returns to step S13. When an arbitrary position on the work cloth 100 is specified using the ultrasonic pen 91, the transmission start signal (Low signal) is output from the ultrasonic pen 91 (the transmission timing is notified), and the transmission start signal may be detected by the CPU 61. The ultrasonic wave is transmitted from the ultrasonic pen 91 simultaneously with the output of the transmission start signal. The velocity of the ultrasonic wave (namely, the sonic velocity) is slower than the transmission speed of the transmission start signal and thus the ultrasonic wave reaches the receivers 94 and 95 at a later timing than the transmission start signal.

If the transmission start signal has been detected (YES at step S13), the timer 27 (refer to FIG. 7) is referred to. A time at which the transmission start signal has been detected is identified as the transmission timing T1 at which the ultrasonic wave has been transmitted (step S14). The identified transmission timing T1 is stored in the RAM 63. Next, a determination is made as to whether at least one of the receiver 94 and the receiver 95 has detected the ultrasonic wave transmitted from the ultrasonic pen 91 (step S15). If the ultrasonic wave has not been detected (NO at step S15), a determination is made as to whether a predetermined time period (one second, for example) has elapsed (step S16). If the predetermined time period has not elapsed (NO at step S16), the processing returns to step S15. Namely, the sewing machine 1 stands by for 1 second until the ultrasonic wave is detected.

For example, in a case where the ultrasonic wave does not reach the receivers 94 and 95 due to being blocked by an object or the like, the predetermined time period elapses. If the predetermined time period elapses (YES at step S16), an error message indicating that the ultrasonic wave has not been detected is displayed on the liquid crystal display 15 (step S17). Through the above-described processing, the sewing machine 1 can notify the user that the error has occurred. Next, the processing returns to step S13.

If the ultrasonic wave has been detected within the predetermined time period (YES at step S15), the timer 27 is referred to. A time at which the ultrasonic wave has been detected is identified as a detection timing T2 at which the ultrasonic wave has been detected (step S18). The identified detection timing T2 is stored in the RAM 63. At step S18, the detection timing T2 is identified for each of the receivers 94 and 95 that have detected the ultrasonic wave. Next, a determination is made as to whether the ultrasonic wave has been detected by both the receivers 94 and 95 (step S19). If either of the receivers 94 and 95 has not detected the ultrasonic wave, it is determined that the ultrasonic wave has not been detected by both the receiver 94 and the receiver 95 (NO at step S19), and the processing returns to step S15. In the following explanation, the detection timing T2 of the receiver 94 is referred to as a detection timing T2*b* and the detection timing T2 of the receiver 95 is referred to as a detection timing T2*c*.

If both the receivers 94 and 95 have detected the ultrasonic wave (YES at step S19), the propagation times Tb and Tc required for the ultrasonic wave to reach the receivers 94 and 95 after the ultrasonic wave was transmitted are calculated (step S20). The propagation times Tb and Tc are each calculated by subtracting the transmission timing T1 from the detection timing T2. In other words, the propagation time Tb with respect to the receiver 94 is (T2*b*−T1). The propagation time Tc with respect to the receiver 95 is (T2*c*−T1).

Next, the second distance values between the transmission source of the ultrasonic wave (namely, the specified coordinates E) and the receivers 94 and 95 are calculated (step S21). Specifically, the propagation times Tb and Tc calculated at step S20, and the sonic velocity V stored in the ROM 62 are used to calculate the second distance value (V×Tb) with respect to the receiver 94 and the second distance value (V×Tc) with respect to the receiver 95.

Next, a position of the transmission source of the ultrasonic wave on the work cloth 100, namely, the specified coordinates E (Xe, Ye, Ze) specified by the ultrasonic pen 91 are identified (step S22). Specifically, (Xe, Ye) are calculated by solving the simultaneous equations represented by the above-described Formulas (5) and (6). In this way, the specified coordinates E (Xe, Ye, Ze) are identified.

Here, the first distance values (Zb−Ze) and (Zc−Ze) in Formulas (5) and (6) have been calculated at step S12. The second distance values (V×Tb) and (V×Tc) have been calculated at step S21. Xb, Yb, Xc and Yc are stored in the ROM 62.

Thus, Xe and Ye can be calculated by solving the simultaneous equations represented by the above-described Formulas (5) and (6). The specified coordinates E (Xe, Ye, Ze) can be identified in this manner.

Next, the identified coordinates (Xe, Ye, Ze) (namely, the position of the transmission source of the ultrasonic wave) is displayed on the liquid crystal display 15 (step S23). Through the above-described processing, the specified coordinates E of the position specified by the ultrasonic pen 91 can be notified to the user. An error message may be displayed on the liquid crystal display 15 in a case where the work cloth 100 cannot be moved such that the position, on the work cloth 100, indicated by the specified coordinates E is moved to the needle drop point (the center of the needle hole in the needle plate 22).

Next, a determination is made as to whether the sewing start/stop switch included in the switch cluster 21 has been pressed (step S24). If the sewing start/stop switch has not been pressed (NO at step S24), the processing at step S24 is repeated. If the sewing start/stop switch has been pressed (YES at step S24), the feed dog 34 is driven and the work cloth 100 is fed such that the X coordinate "Xe" and the Y coordinate "Ye" of the specified coordinates E specified at step S22 are positioned at the needle drop point (step S25). The specified coordinates E indicate the position, on the work cloth 100, of the transmission source of the ultrasonic wave. Next, sewing is performed on the work cloth 100 (step S26). By the processing at steps S25 and S26, the sewing is started from the position (the specified coordinates E) specified by the ultrasonic pen 91. When the sewing is completed, the first main processing ends.

In the present embodiment, when the user specifies the position on the work cloth 100 using the ultrasonic pen 91, the position of the transmission source of the ultrasonic wave on the work cloth 100 (the position specified by the user) may be identified based on the ultrasonic wave detected by the receivers 94 and 95 and on the thickness Ze of the work cloth 100 detected by the potentiometer 51 (step S22). In other words, the user may easily set the position on the work cloth 100 on which the sewing is to be performed, by using the ultrasonic pen 91. Further, based on the identified position of the transmission source of the ultrasonic wave, the sewing may be performed at the position, on the work cloth 100, specified by using the ultrasonic pen 91 (steps S25 and S26). As a result, it is possible to perform the sewing at the position on the work cloth 100 set by the user, and user convenience may be thus improved.

As described above, in a case where the thickness Ze of the work cloth 100 is not taken into account when identifying the transmission source of the ultrasonic wave, an error may occur with respect to the identified position (X coordinate, Y coordinate) of the transmission source on the work cloth 100. The greater the thickness Ze is, the greater error may occur with respect to the position (X coordinate, Y coordinate) of the transmission source of the ultrasonic wave. In the present embodiment, the thickness Ze of the work cloth 100 is detected and the position (Xe, Ye) of the transmission source of the ultrasonic wave is identified using the detected thickness Ze (step S22). As a result, even if the thickness Ze of the work cloth 100 changes, it is possible to accurately identify the position of the transmission source. In other words, even when the work cloth having the different thickness Ze is used, it is possible to accurately identify the position of the transmission source. The position of the transmission source can be highly accurately identified, and thus the sewing can be accurately performed at the position (the specified coordinates E) specified by the ultrasonic pen 91.

In the present embodiment, the second distance values can be calculated using the transmission timing T1 and the detection timing T2. Then, the position of the transmission source of the ultrasonic wave on the work cloth 100 can be identified using the first distance values, the second distance values, the coordinates B (Xb, Yb, Zb) of the receiver 94, and the coordinates C (Xc, Ye, Ze) of the receiver 95. For that reason, it is possible to correct an error in the position of the transmission source resulting from an influence of the thickness Ze. Thus, the position of the transmission source can be identified with a high degree of accuracy. As a result, it is possible to accurately perform the sewing at the position specified by the ultrasonic pen 91.

When the user uses the ultrasonic pen 91 to specify the position on the work cloth 100, the ultrasonic wave is transmitted from the ultrasonic transmitter 913. In addition, the transmission timing is notified by the transmission start signal being output from the signal output circuit 914. As a result, in the processing at step S22, it is possible to identify the position of the transmission source of the ultrasonic wave on the work cloth 100. The user can use the ultrasonic pen 91 to easily specify the position on the work cloth 100. Thus, user convenience may be improved.

A second embodiment will be explained. In the first embodiment, the ultrasonic pen 91 may transmit the ultrasonic wave and the transmission start signal. In the second embodiment, an ultrasonic pen 92 (refer to FIG. 10) may transmit the ultrasonic wave but does not transmit the transmission start signal.

Figure 10:
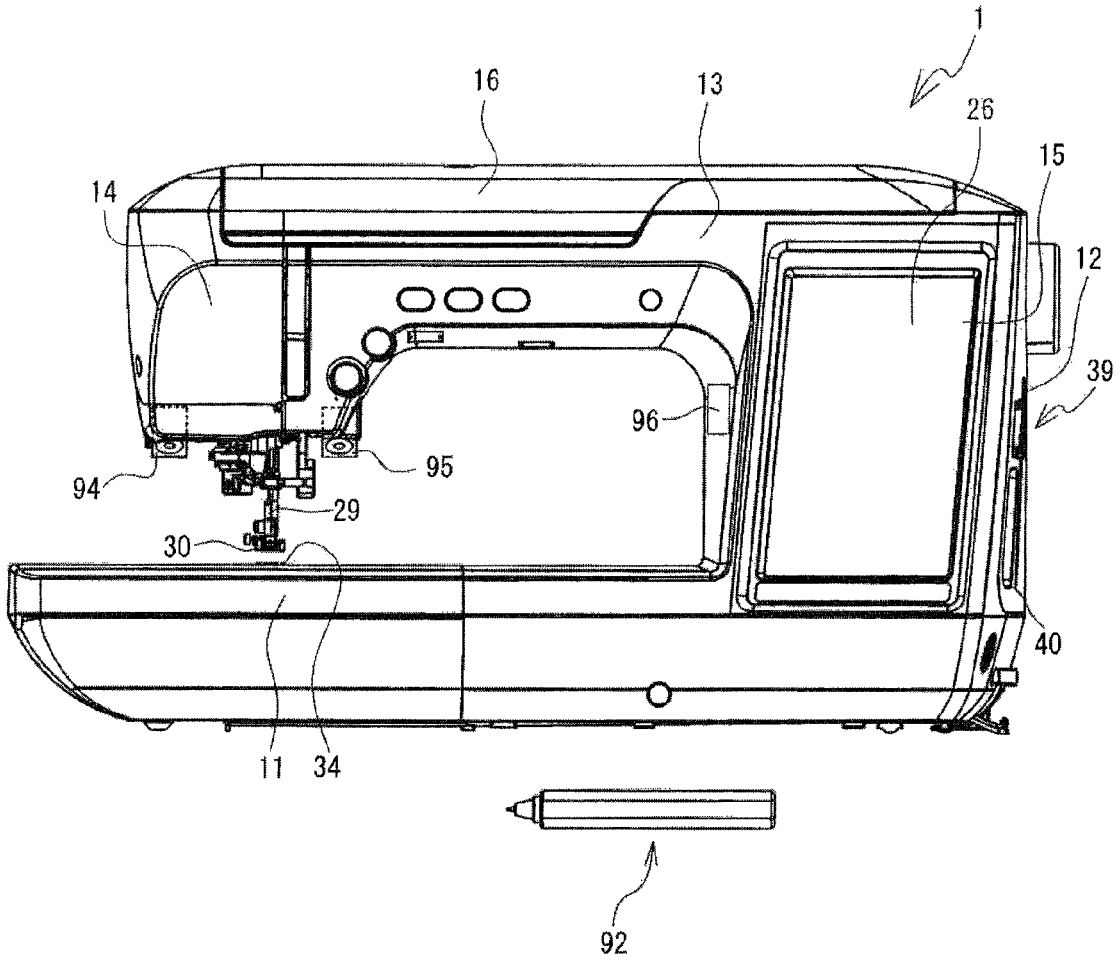
FIG. 10 is a front view of a sewing machine according to a second embodiment.

In the second embodiment, as shown in FIG. 10, in addition to the receivers 94 and 95 of the first embodiment, the sewing machine 1 is provided with a receiver 96 that has the same structure as the receivers 94 and 95. Specifically, the three receivers 94, 95 and 96 are provided on the sewing machine 1. The positions of the receivers 94 and 95 are the same as those of the first embodiment. The receiver 96 is provided on the left surface of the pillar 12, in a posture in which the opening 941 faces to the left.

The ultrasonic pen 92 of the second embodiment is not provided with a cable that connects to the sewing machine 1. The ultrasonic pen 92 accommodates a battery (not shown in the drawings). The ultrasonic pen 92 operates by electric power of the battery. Thus, in a case where the ultrasonic pen 92 is used, the cable does not cause interference. The ultrasonic pen 92 includes the ultrasonic transmitter 913 but does not include a signal output circuit.

Figure 11:
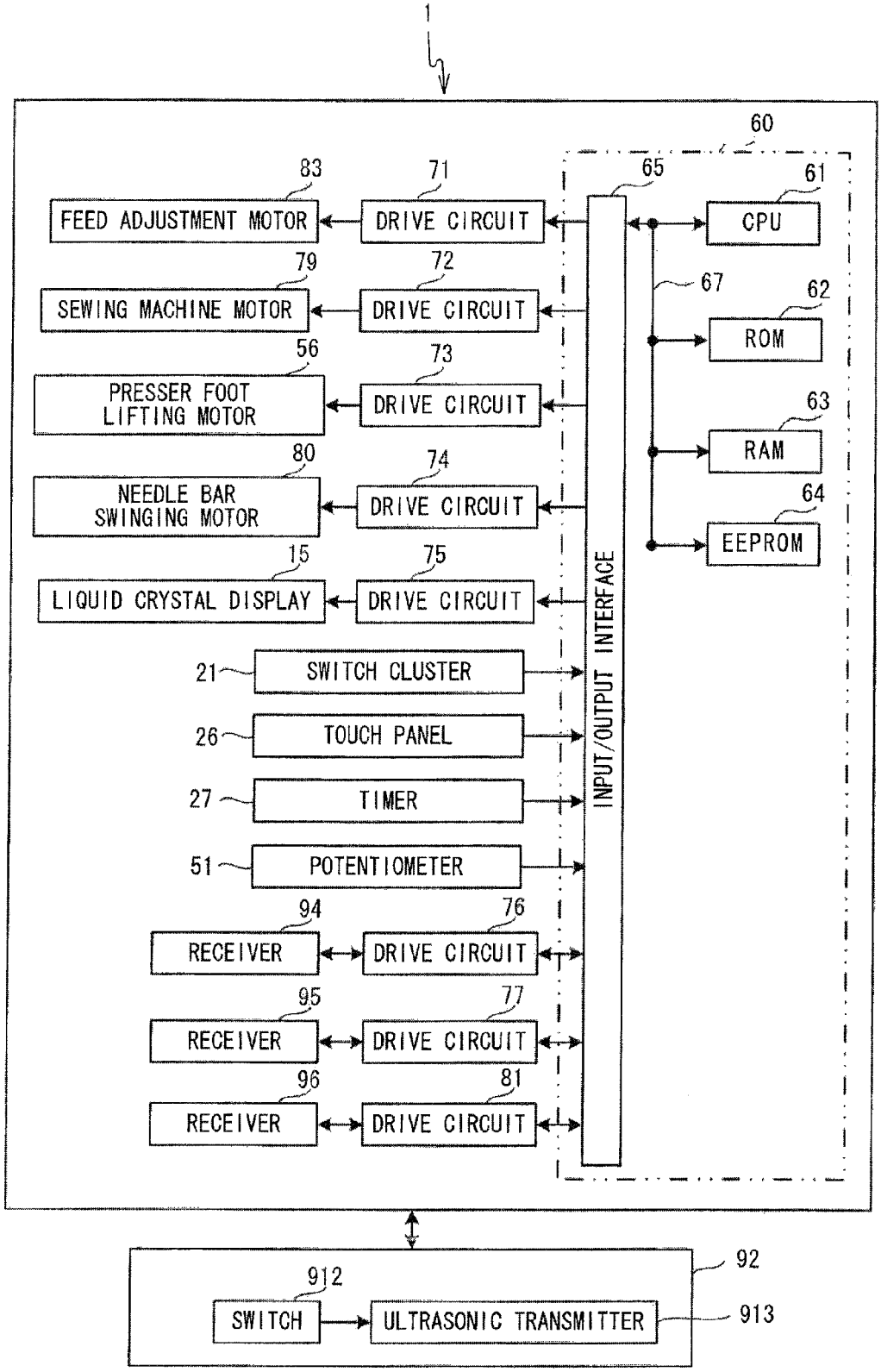
FIG. 11 is a block diagram showing an electrical configuration of the sewing machine and an ultrasonic pen according to the second embodiment.

An electrical configuration of the sewing machine 1 and the ultrasonic pen 92 of the second embodiment will be explained with reference to FIG. 11. As shown in FIG. 11, in comparison to the sewing machine 1 of the first embodiment (refer to FIG. 7), the sewing machine 1 of the second embodiment further includes the receiver 96 and a drive circuit 81. The drive circuit 81 is connected to the input/output interface 65. The drive circuit 81 may drive the receiver 96. In comparison to the case of the first embodiment (refer to FIG. 7), the ultrasonic pen 92 does not include the signal output circuit 914. The ultrasonic pen 92 is not electrically connected to the sewing machine 1.

Figure 12:
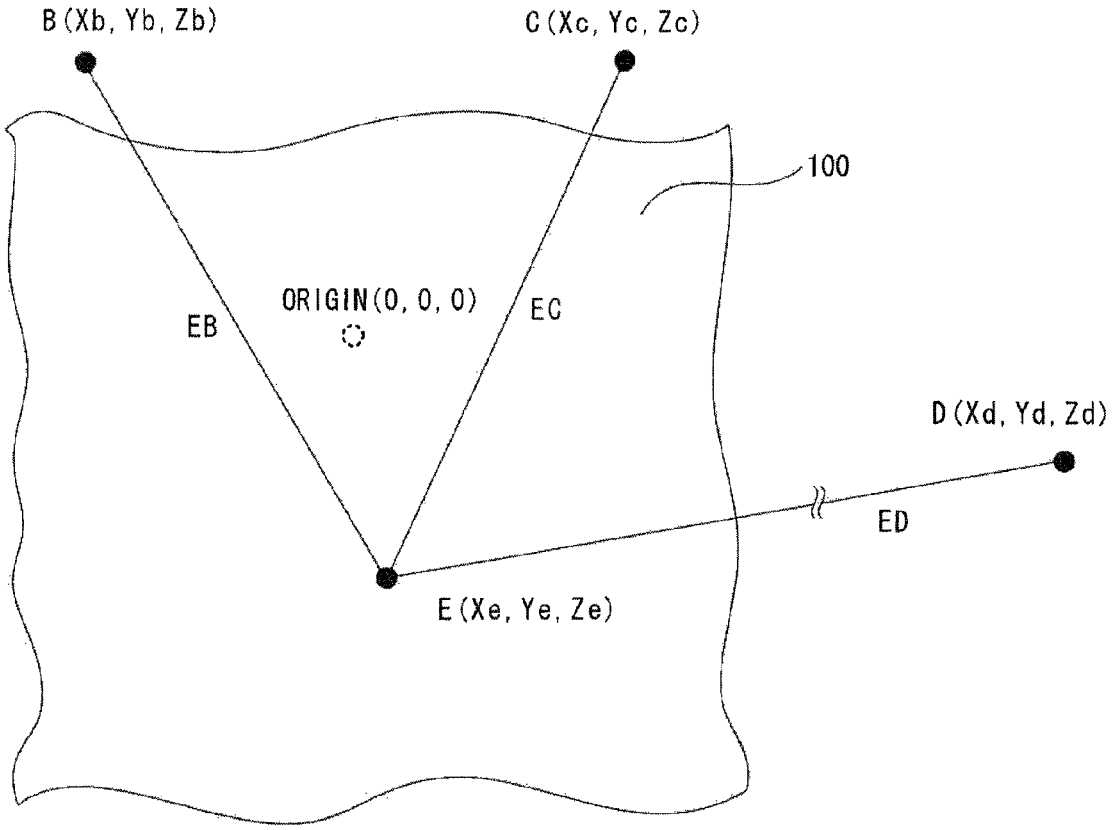
FIG. 12 is a plan view of the work cloth that is placed on a needle plate, showing positional relationships of respective coordinates in order to illustrate a method of calculating specified coordinates E according to the second embodiment.

A calculation method used to calculate the position of the transmission source of the ultrasonic wave in the second embodiment, namely, a calculation method used to calculate the position specified by using the ultrasonic pen 92, will be explained with reference to FIG. 12. In the following explanation, as shown in FIG. 12, coordinates D indicating the position of the receiver 96 are denoted by (Xd, Yd, Zd). A distance between the specified coordinates E and the coordinates D of the receiver 96 is referred to as a "distance ED." Other conditions (the origin, the coordinates B, the coordinates C, the specified coordinates E, and the like) are the same as those of the first embodiment (refer to FIG. 8). In this case, relationships of the following Formulas (7) to (9) are obtained.

$$(Xb-Xe)^2+(Yb-Ye)^2+(Zb-Ze)^2=(EB)^2 \quad \text{Formula (7):}$$

$$(Xe-Xe)^2+(Yc-Ye)^2+(Zc-Ze)^2=(EC)^2 \quad \text{Formula (8):}$$

$$(Xd-Xe)^2+(Yd-Ye)^2+(Zd-Ze)^2=(ED)^2 \quad \text{Formula (9):}$$

Formulas (7) to (9) are each the same as the equation to calculate a spherical surface. In the present embodiment, the ultrasonic wave transmitted from the ultrasonic pen 92 (the ultrasonic wave transmitted from the specified coordinates E) can be received by the receivers 94, 95, and 96, which are provided at the coordinates B, the coordinates C, and the coordinates D. A time period required from when the ultrasonic wave is transmitted from the ultrasonic pen 92 at the specified coordinates E to when the ultrasonic wave reaches the receiver 96 (to be detected by the receiver 96) is a propagation time Td. The propagation times Tb and Tc are the same as in the first embodiment. The distances can be expressed as (speed×time). Thus, the distances EB, EC and ED between the specified coordinates E and the respective receivers 94, 95 and 96 can be expressed by the following Formulas (10), (11), and (12).

$$EB=V\times Tb \quad \text{Formula (10):}$$

$$EC=V\times Tc \quad \text{Formula (11):}$$

$$ED=V\times Td \quad \text{Formula (12):}$$

Further, Formulas (11) and (12) can be transformed into the following Formulas (13) and (14).

$$EC=V\times Tc=V\times(Tc-Tb)+V\times Tb \quad \text{Formula (13):}$$

$$ED=V\times Td=V\times(Td-Tb)+V\times Tb \quad \text{Formula (14):}$$

The ultrasonic pen 92 of the second embodiment does not transmit the transmission start signal. Thus, in contrast to the first embodiment, the CPU 61 of the sewing machine 1 does not acquire the transmission timing T1. The CPU 61 may receive the detection timings T2*b*, T2*c*, and T2*d* at which the respective receivers 94, 95, and 96 have been detected the ultrasonic wave. T2*d* is the detection timing of the receiver 96. The CPU 61 does not acquire the transmission timing T1, and thus does not calculate the propagation times Tb, Tc, and Td for the ultrasonic wave to reach the respective receivers 94, 95, and 96. Therefore, the propagation times Tb, Tc, and Td are unknown values. However, the propagation time difference (Tc−Tb) in Formula corresponds to a difference between the detection timing T2*c* and the detection timing T2*b*. The propagation time difference (Td−Tb) in Formula (14) corresponds to a difference between the detection timing T2*d* and the detection timing T2*b*. Thus, the above-described Formulas (13) and (14) can be transformed into the following Formulas (15) and (16).

$$EC=V\times(T2c-T2b)+V\times Tb \quad \text{Formula (15):}$$

$$ED=V\times(T2d-T2b)+V\times Tb \quad \text{Formula (16):}$$

The above-described Formulas (10) to (16) are substituted into the Formulas (7) to (9) and the following Formulas (17) to (19) are obtained.

$$(Xb-Xe)^2+(Yb-Ye)^2+(Zb-Ze)^2=(V\times Tb)^2 \quad \text{Formula (17):}$$

$$(Xc-Xe)^2+(Yc-Ye)^2+(Zc-Ze)^2=\{V\times(T2c-T2b)+V\times Tb\}^2 \quad \text{Formula (18):}$$

$$(Xd-Xe)^2+(Yd-Ye)^2+(Zd-Ze)^2=\{V\times(T2d-T2b)+V\times Tb\}^2 \quad \text{Formula (19):}$$

In the above-described Formulas (17) to (19), the coordinates B (Xb, Yb, Zb) of the receiver 94, the coordinates C (Xc, Yc, Zc) of the receiver 95, and the coordinates D (Xd, Yd, Zd) of the receiver 96 are stored in advance in the ROM 62. The sonic velocity V is stored in the ROM 62. The detection timings T2*b*, T2*c*, and T2*d* can be acquired by processing at step S181 (refer to FIG. 13), which will be described below. The specified coordinates E are the coordinates on the work cloth 100 that are specified using the ultrasonic pen 92. Thus, Ze of the specified coordinates E (Xe, Ye, Ze) indicates the thickness of the work cloth 100. As a result, the unknown values in the Formulas (17) to (19) are Xe, Ye, and Tb. Xe, Ye, and Tb can be calculated by solving the simultaneous equations represented by the above-described Formulas (17) to (19). In other words, the X coordinate "Xe" and the Y coordinate "Ye" of the specified coordinates E specified on the work cloth 100 using the ultrasonic pen 92 can be calculated. The above-described Formulas (17) to (19) are stored in the ROM 62.

In the following explanation, of the Formulas (17) to (19), distances in the up-down direction from the upper surface of the work cloth 100 to the receivers 94, 95, and 96, namely the distances (Zb−Ze), (Zc−Ze), and (Zd−Ze), are referred to as the "first distance values." Distances from the transmission source of the ultrasonic wave (namely, the specified coordinates E) to the receivers 94, 95, and 96, namely the distances (V×Tb), {V×(T2*c*−T2*b*)+V×Tb}, and {V×(T2*d*−T2*b*)+V×Tb}, are referred to as the "third distance values."

Second main processing will be explained with reference to a flowchart shown in FIG. 13. In the second main processing, the same reference numerals are assigned to processing that is the same as that of the first main processing (refer to FIG. 9) and a detailed explanation of that processing is omitted. In the following explanation, the coordinates B of the receiver 94 are denoted by (Xb, Yb, Zb), the coordinates C of the receiver 95 are denoted by (Xc, Yc, Zc) and the coordinates D of the receiver 96 are denoted by (Xd, Yd, Zd) (refer to FIG. 12).

Figure 13:
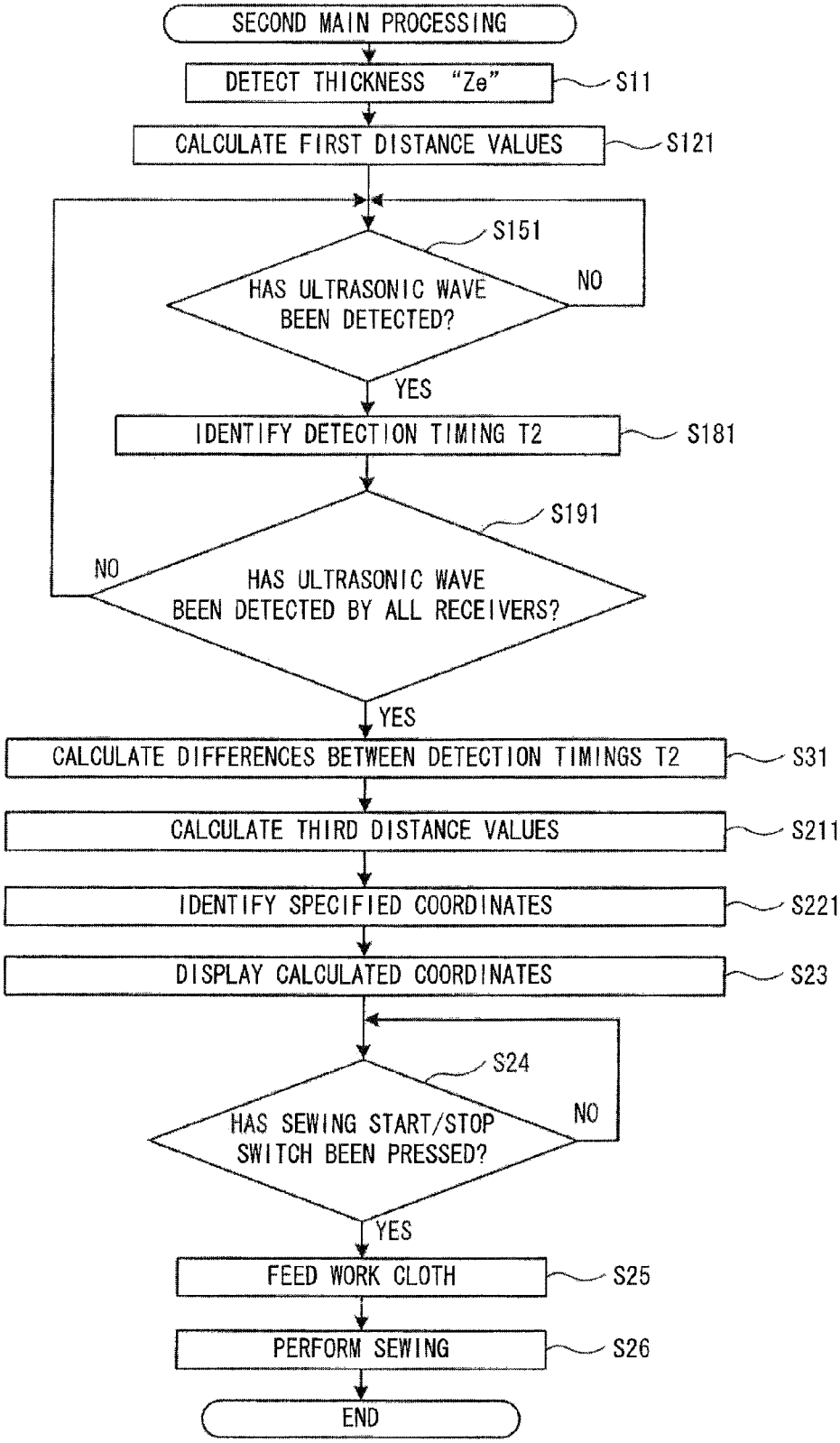
FIG. 13 is a flowchart showing second main processing according to the second embodiment.

As shown in FIG. 13, in the second main processing, first, similarly to the first main processing, the thickness Ze is detected (step S11). Next, the first distance values are calculated (step S121). Specifically, the Z coordinates (Zb, Ze, Zd) of the receivers 94, 95, and 96 that are stored in the ROM 62 are read out. The read out Z coordinates and the thickness Ze detected at step S11 are used to calculate the first distance value (Zb−Ze) for the receiver 94, the first distance value (Zc−Ze) for the receiver 95 and the first distance value (Zd−Ze) for the receiver 96. At step S221, which will be described below, the first distance values (Zb−Ze), (Zc−Ze), and (Zd−

Ze) calculated at step S121 are substituted into the above-described Formulas (17), (18) and (19).

Next, a determination is made as to whether the ultrasonic wave transmitted from the ultrasonic pen 92 has been detected by at least one of the receivers 94, 95, and 96 (step S151). If the ultrasonic wave has not been detected (NO at step S151), the processing at step S151 is repeated. Namely, the sewing machine 1 stands by until the specified coordinates E are specified using the ultrasonic pen 92 and the ultrasonic wave transmitted from the ultrasonic pen 92 is detected.

If the ultrasonic wave has been detected (YES at step S151), the timer 27 is referred to. The time at which the ultrasonic wave has been detected is identified (acquired) as the detection timing T2 at which the ultrasonic wave is detected (step S181). The identified detection timing T2 is stored in the RAM 63. At step S181, the detection timing T2 is identified for each of the receivers 94, 95, and 96 that have detected the ultrasonic wave. Next, a determination is made as to whether or not the ultrasonic wave has been detected by all of the receivers 94, 95, and 96 (step S191). In a case where there is one or more of the receivers 94, 95 and 96 that have not detected the ultrasonic wave, it is determined that the ultrasonic wave has not been detected by at least one of the receivers 94 to 96 (NO at step S191) and the processing returns to step S151. In the following explanation, the detection timings T2 for the receivers 94, 95, and 96 are referred to as detection timings T2*b*, T2*c*, and T2*d*, respectively.

In a case where the ultrasonic wave has been detected by all of the receivers 94, 95, and 96 (YES at step S191), differences between the detection timings T2, namely, (T2*c*−T2*b*) and (T2*d*−T2*b*), are calculated (step S31).

Next, third distance values between the transmission source of the ultrasonic wave (namely, the specified coordinates E) and the receivers 94, 95, and 96 are calculated (step S211). Specifically, the detection timing T2*b* identified at step S181, (T2*c*−T2*b*) and (T2*d*−T2*b*) calculated at step S31, and the sonic velocity V stored in the ROM 62 are used to calculate the third distance value (V×Tb) with respect to the receiver 94, the third distance value {V×(T2*c*−T2*b*)+V×Tb} with respect to the receiver 95, and the third distance value {V×(T2*d*−T2*b*)+V×Tb} with respect to the receiver 96. Here, the value of the propagation time Tb is unknown, and the propagation time Tb remains as the unknown value.

Next, the position of the ultrasonic wave transmission source on the work cloth 100, namely, the specified coordinates E (Xe, Ye, Ze) specified using the ultrasonic pen 92 are identified (step S221). Specifically, (Xe, Ye) and Tb are calculated by solving the simultaneous equations represented by the above-described Formulas (17) to (19). Thus, the specified coordinates E (Xe, Ye, Ze) are identified.

Here, in the Formulas (17) to (19), the first distance values (Zb−Ze), (Zc−Ze), and (Zd−Ze) have been calculated at step S121. The third distance values (V×Tb), {V×(T2*c*−T2*b*)+V×Tb}, and {V×(T2*d*−T2*b*)+V×Tb} have been calculated at step S211. However, the propagation time Tb is unknown. The sonic velocity V is stored in the ROM 62. Xb, Yb, Xc, Yc, Xd, and Yd are stored in the ROM 62. Thus, the unknown values are Xe, Ye, and Tb, only. As a result, Xe, Ye and Tb can be calculated by solving the simultaneous equations represented by the above-described Formulas (17) to (19). In this way, the specified coordinates E (Xe, Ye, Ze) are identified. Next, the processing from steps S23 to S26 is performed in a similar manner to the first embodiment.

In the present embodiment, similarly to the first embodiment, the user can easily set a position on the work cloth 100 on which the sewing is to be performed using the ultrasonic pen 92. Further, the sewing can be performed on the work cloth 100 at the position set by the user. As a result, user convenience may be improved. In addition, even if the thickness Ze of the work cloth 100 is changed, the position of the transmission source of the ultrasonic wave (the position specified by the user) can be accurately identified. In other words, even if the work cloth 100 having a different thickness Ze is used, it is possible to accurately identify the position of the transmission source. Therefore, the sewing machine 1 can identify the position of the transmission source with a high degree of accuracy. As a result, the sewing can be accurately performed at the position (the specified coordinates E) specified using the ultrasonic pen 92.

In the second embodiment, the third distance values can be calculated from the detection timings T2 at which the ultrasonic wave has been detected by the three receivers 94, 95, and 96. Then, it is possible to identify the position of the transmission source of the ultrasonic wave on the work cloth 100 using the first distance values, the third distance values, the coordinates B (Xb, Yb, Zb) of the receiver 94, the coordinates C (Xc, Yc, Zc) of the receiver 95, and the coordinates D (Xd, Yd, Zd) of the receiver 96. As a result, an error in the position of the transmission source resulting from the influence of the thickness Ze can be corrected. Thus, the position of the transmission source can be identified with a high degree of accuracy. Accordingly, the sewing can be accurately performed at the position specified using the ultrasonic pen 92.

Strictly speaking, the identified position is not a position on the work cloth 100 that is touched and pressed by the pen tip 911, but is a position of the ultrasonic transmitter 913 provided in the ultrasonic pen 91 (or the ultrasonic pen 92). However, the pen tip 911 and the ultrasonic transmitter 913 are arranged such that the pen tip 911 and the ultrasonic transmitter 913 are extremely close together. As a result, the position of the ultrasonic transmitter 913 may be regarded as being the position on the work cloth 100 that is touched and pressed by the pen tip 911.

The present disclosure is not limited to the above-described embodiments and various modifications may be made. For example, in the above-described embodiments, the potentiometer 51 is used in order to detect the thickness Ze, but the present disclosure is not limited to this example. For example, light or an ultrasonic wave may be emitted toward the work cloth 100 and the thickness Ze may be detected by detecting the light or the ultrasonic wave reflected by the work cloth 100. The sewing machine 1 may be provided with a camera. An image of the work cloth 100 may be captured by the camera and the thickness Ze may be detected based on the captured image.

In the first embodiment, the first distance values are calculated at step S12, and the second distance values are calculated at step S21. Then, at step S22, the first distance values and the second distance values are substituted into Formulas (5) and (6), and (Xe, Ye) in the specified coordinates E are calculated. (Xe, Ye) in the specified coordinates E may be calculated using a different method. For example, the processing at steps S12 and S21 need not necessarily be performed. The values Xb, Yb, Zb, Ze, V, Tb, Xc, Yc, Zc, and Tc may be directly substituted into Formulas (5) and (6) at step S22, and (Xe, Ye) of the specified coordinates E may be thus calculated. In this case, the calculation of the first distance values (Zb−Ze) and (Zc−Ze) performed at step S12 may be performed at step S22. Further, the calculation of the second distance values (V×Tb) and (V×Tc) performed at step S21 may be performed at step S22.

In the second embodiment, the first distance values are calculated at step S121, and the values calculated at step S31 are used to calculate the third distance values at step S211. At step S221, the first distance values and the third distance values are substituted into Formulas (17) to (19), and (Xe, Ye) in the specified coordinates E and Tb are calculated. (Xe, Ye) in the specified coordinates E and Tb may be calculated using a different method. For example, the processing at steps S121 and S211 need not necessarily be performed. The values Xb, Yb, Zb, Ze, V, Xc, Yc, Zc, T2*c*, T2*b*, and T2*d* may be directly substituted into Formulas (17) to (19) at step S221, and (Xe, Ye) of the specified coordinates E and Tb may be thus calculated. In this case, the calculation of the first distance values (Zb−Ze), (Zc−Ze), and (Zd−Ze) performed at step S121 may be performed at step S221. Further, the calculation of the third distance values (V×Tb), {V×(T2*c*−T2*b*)+V×Tb}, and {V×(T2*d*−T2*b*)+V×Tb} performed at step S211 may be performed at step S221.

In the first embodiment, in a case where the electrical transmission start signal (the Low signal) from the ultrasonic pen 91 is detected, and the transmission timing T1 is acquired (steps S13 and S14). However, the transmission timing T1 may be detected using a different method. For example, an infrared transmitter may be provided in the ultrasonic pen 91. Then, the ultrasonic pen 91 may transmit an infrared ray at the same time as transmitting the ultrasonic wave. Further, an infrared detector that may detect the infrared ray transmitted from the ultrasonic pen 91 may be provided in the sewing machine 1. The infrared ray travels at the speed of light. Thus, the infrared ray reaches the infrared detector at substantially the same time as the start of transmission of the ultrasonic wave. As a result, the sewing machine 1 can set the transmission timing T1 as a time point at which the infrared detector detects the infrared ray transmitted from the ultrasonic pen 91.

The sonic velocity V changes depending on ambient temperature. For example, a temperature sensor, such as a thermistor, may be provided in the sewing machine 1 and the temperature may be measured. Then, the sonic velocity V corresponding to the ambient temperature may be used.

At step S25, the work cloth 100 is fed by the feed dog 34. However, the work cloth 100 may be moved by a different method. For example, a known embroidery unit may be attached to the sewing machine 1. The work cloth 100 may be held by an embroidery frame, and the embroidery frame may be moved in the X direction and in the Y direction. Then, the work cloth 100 may be moved such that the position, on the work cloth 100, indicated by the X coordinate Xe and the Y coordinate Ye of the specified coordinates E calculated at step S22, namely the position of the transmission source of the ultrasonic wave on the work cloth 100, is moved to the needle drop point.

The positions of the receivers 94 to 96 in the first and second embodiments may be changed. For example, the positions of the receivers 94 to 96 on the sewing machine 1 may be changed. The receivers 94 to 96 may be disposed on the outside of the sewing machine 1. The receivers 94 to 96 may be provided on an embroidery unit that can be attached to the sewing machine 1.

In the first embodiment, the time at which the transmission start signal has been detected is taken as the transmission timing T1 (step S14 in FIG. 9), and the time at which the ultrasonic wave has been detected is taken as the detection timing T2 (step S18 in FIG. 9). Then the difference between T2 and T1 is calculated and the propagation times Tb and Tc are calculated (step S20 in FIG. 9). However, the propagation times Tb and Tc may be calculated using a different method. For example, a time point at which the transmission start signal has been detected, namely, the transmission timing T1 may be assumed to be zero seconds. Then, an elapsed time period from the time point at which the transmission start signal has been detected may be measured, and the elapsed time period until the ultrasonic wave has been detected may be taken as the detection timing T2. In this case, the times of the detection timing T2 may become the propagation times Tb and Tc.

In the first embodiment, the two receivers 94 and 95 are provided. However, the number of the receivers is not limited to two. In the first embodiment, it is sufficient that at least two receivers are provided. For example, the number of the receivers may be three or more. In the second embodiment, the three receivers 94, 95 and 96 are provided. However, the number of the receivers is not limited to three. In the second embodiment, it is sufficient that at least three receivers are provided. For example, the number of the receivers may be four or more.

In the above-described embodiments, the ultrasonic pens 91 and 92 may be used when specifying the position. The device that may transmit the ultrasonic wave need not necessarily be in the form of a pen. Another device that is capable of transmitting the ultrasonic wave may be used.

A third embodiment will be explained. The number of the receivers may be one. For example, it is assumed that the one receiver is the receiver 94 that is provided on the left lower edge of the head 14. Then, with respect to the coordinates B indicating the position of the receiver 94, specified coordinates indicating the specified position specified by the ultrasonic pen 91 are referred to as coordinates F. At this time, the X coordinates of the coordinates B and the coordinates F are assumed to be the same. In other words, the coordinates B are assumed to be (Xb, Yb, Zb) and the coordinates F are assumed to be (Xb, Yf, Zf). In this case, it is possible to calculate a distance FB between the coordinates F and the coordinates B, based on the propagation time required for the ultrasonic wave transmitted from the ultrasonic pen 91 that is at the coordinates F of the specified position to reach the receiver 94. The coordinates B are known values. The Z coordinate "Zf" of the coordinates F is the thickness of the work cloth that is detected by the potentiometer 51. Thus, with respect to the needle drop point that is the origin, the Y coordinate "Yf" of the coordinates F of the specified position can be calculated.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

at least one ultrasonic wave detecting portion configured to detect an ultrasonic wave;

a thickness detecting portion configured to detect a thickness of a work cloth;

a processor; and a memory configured to store computer-readable instructions that instruct the sewing machine to execute steps comprising:

identifying a position, on the work cloth, of a transmission source of the ultrasonic wave, based on information pertaining to the ultrasonic wave that has been detected by the at least one ultrasonic wave detecting portion and on the thickness that has been detected by the thickness detecting portion; and controlling sewing on the work cloth based on the position of the transmission source that has been identified.

2. The sewing machine according to claim 1, further comprising:

a presser bar whose lower end a presser foot is attachable to, the presser foot being configured to press the work cloth, wherein the thickness detecting portion is configured to detect the thickness by detecting a height position of the presser bar when the presser foot presses the work cloth.

3. The sewing machine according to claim 1, wherein the computer-readable instructions further instruct the sewing machine to execute steps comprising:

calculating a first distance value based on a distance between the at least one ultrasonic wave detecting portion and one of a bed of the sewing machine and a needle plate and on the thickness that has been detected by the thickness detecting portion, the needle plate being provided on the bed, the distance being in an orthogonal direction that is orthogonal to an upper surface of the one of the bed and the needle plate, the first distance value being a distance in the orthogonal direction between the at least one ultrasonic wave detecting portion and an upper surface of the work cloth; and identifying the position of the transmission source on the work cloth based on the first distance value that has been calculated and on the information pertaining to the ultrasonic wave that has been detected by the at least one ultrasonic wave detecting portion.

4. The sewing machine according to claim 3, wherein the at least one ultrasonic wave detecting portion includes a plurality of ultrasonic wave detecting portions that are provided in first installation positions being different positions, the sewing machine further comprises a first storage portion configured to store the first installation positions, the computer-readable instructions further instruct the sewing machine to execute steps comprising:

acquiring a transmission timing at which the ultrasonic wave has been transmitted; and calculating a second distance value based on the transmission timing that has been acquired and on a detection timing at which the ultrasonic wave is detected by each of the plurality of ultrasonic wave detecting portions, the second distance value being a distance between the transmission source of the ultrasonic wave and each of the plurality of ultrasonic wave detecting portions; and the identifying the position of the transmission source of the ultrasonic wave includes identifying the position of the transmission source of the ultrasonic wave on the work cloth based on the first distance value that has been calculated, on the second distance value that has been calculated, and on the first installation positions that are stored in the first storage portion.

5. The sewing machine according to claim 4, further comprising:

an ultrasonic wave transmitting portion configured to transmit the ultrasonic wave; and a notifying portion configured to notify the transmission timing of the ultrasonic wave that has been transmitted by the ultrasonic wave transmitting portion; wherein the acquiring the transmission timing includes acquiring the transmission timing that has been notified by the notifying portion.

6. The sewing machine according to claim 3, wherein the at least one ultrasonic wave detecting portion includes three ultrasonic wave detecting portions that are provided in second installation positions being different positions, the sewing machine further comprises a second storage portion configured to store the second installation positions, the computer-readable instructions further instruct the sewing machine to execute a step comprising:

calculating a third distance value based on a detection timing at which the ultrasonic wave has been detected by each of the three ultrasonic wave detecting portions, the third distance value being a distance between the transmission source of the ultrasonic wave and each of the three of ultrasonic wave detecting portions, and the identifying the position of the transmission source of the ultrasonic wave includes identifying the position of the transmission source of the ultrasonic wave on the work cloth based on the first distance value that has been calculated, on the third distance value that has been calculated, and on the second installation positions that are stored in the second storage portion.

7. A non-transitory computer-readable medium storing a control program executable on a sewing machine, the program comprising computer-readable instructions, when executed, to cause the sewing machine to perform the steps of:

identifying a position, on a work cloth, of a transmission source of the ultrasonic wave, based on information pertaining to a ultrasonic wave that has been detected by at least one ultrasonic wave detecting portion of the sewing machine and on a thickness that has been detected by a thickness detecting portion of the sewing machine, the at least one ultrasonic wave detecting portion being configured to detect the ultrasonic wave, and the thickness detecting portion being configured to detect the thickness of the work cloth; and controlling sewing on the work cloth based on the position of the transmission source that has been identified.

8. The non-transitory computer-readable medium according to claim 7, wherein the thickness is detected by detecting a height position of a presser bar of the sewing machine when a presser foot presses the work cloth, the presser foot being attachable to a lower end of the presser bar and being configured to press the work cloth.

9. The non-transitory computer-readable medium according to claim 7, wherein the program further comprising computer-readable instructions, when executed, to cause the sewing machine to perform the steps of:

calculating a first distance value based on a distance between the at least one ultrasonic wave detecting portion and one of a bed of the sewing machine and a needle plate and on the thickness that has been detected by the thickness detecting portion, the needle plate being provided on the bed, the distance being in an orthogonal direction that is orthogonal to an upper surface of the one of the bed and the needle plate, the first distance value being a distance in the orthogonal direction between the at least one ultrasonic wave detecting portion and an upper surface of the work cloth; and identifying the position of the transmission source on the work cloth based on the first distance value that has been calculated and on the information pertaining to the ultrasonic wave that has been detected by the at least one ultrasonic wave detecting portion.

10. The non-transitory computer-readable medium according to claim 9, wherein the program further comprising computer-readable instructions, when executed, to cause the sewing machine to perform the steps of:

acquiring a transmission timing at which the ultrasonic wave has been transmitted; and calculating a second distance value based on the transmission timing that has been acquired and on a detection timing at which the ultrasonic wave is detected by each of a plurality of ultrasonic wave detecting portions, the second distance value being a distance between the transmission source of the ultrasonic wave and each of the plurality of ultrasonic wave detecting portions, the at least one ultrasonic wave detecting portion including the plurality of ultrasonic wave detecting portions that are provided in first installation positions being different positions, and the identifying the position of the transmission source of the ultrasonic wave includes identifying the position of the transmission source of the ultrasonic wave on the work cloth based on the first distance value that has been calculated, on the second distance value that has been calculated, and on the first installation positions that are stored in a memory.

11. The non-transitory computer-readable medium according to claim 10, wherein the acquiring the transmission timing includes acquiring the transmission timing that has been notified by a notifying portion of the sewing machine, the notifying portion being configured to notify the transmission timing of the ultrasonic wave that has been transmitted by a ultrasonic wave transmitting portion of the sewing machine, and the ultrasonic wave transmitting portion being configured to transmit the ultrasonic wave.

12. The non-transitory computer-readable medium according to claim 9, wherein the program further comprising computer-readable instructions, when executed, to cause the sewing machine to perform the step of:

calculating a third distance value based on a detection timing at which the ultrasonic wave has been detected by each of three ultrasonic wave detecting portions, the third distance value being a distance between the transmission source of the ultrasonic wave and each of the three of ultrasonic wave detecting portions, the at least one ultrasonic wave detecting portion including the three ultrasonic wave detecting portions that are provided in second installation positions being different positions, and the identifying the position of the transmission source of the ultrasonic wave includes identifying the position of the transmission source of the ultrasonic wave on the work cloth based on the first distance value that has been calculated, on the third distance value that has been calculated, and on the second installation positions that are stored in a memory.

* * * * *